US010305191B2

(12) United States Patent
Lindenmeier et al.

(10) Patent No.: US 10,305,191 B2
(45) Date of Patent: May 28, 2019

(54) MULTI-STRUCTURE BROADBAND MONOPOLE ANTENNA FOR TWO FREQUENCY BANDS IN THE DECIMETER WAVE RANGE SEPARATED BY A FREQUENCY GAP, FOR MOTOR VEHICLES

(71) Applicant: FUBA AUTOMOTIVE ELECTRONICS GMBH, Bad Salzdetfurth (DE)

(72) Inventors: Stefan Lindenmeier, Gauting-Buchendorf (DE); Heinz Lindenmeier, Planegg (DE)

(73) Assignee: FUBA AUTOMOTIVE ELECTRONICS GMBH, Bad-Salzdetfurth (DE)

( * ) Notice: Subject to any disclaimer, the term of this patent is extended or adjusted under 35 U.S.C. 154(b) by 14 days.

(21) Appl. No.: 15/511,952

(22) PCT Filed: Sep. 17, 2015

(86) PCT No.: PCT/EP2015/071294
§ 371 (c)(1),
(2) Date: Mar. 16, 2017

(87) PCT Pub. No.: WO2016/042061
PCT Pub. Date: Mar. 24, 2016

(65) Prior Publication Data

US 2017/0294714 A1 Oct. 12, 2017

(30) Foreign Application Priority Data

Sep. 21, 2014 (DE) ..... 10 2014 013 926

(51) Int. Cl.
*H01Q 1/32* (2006.01)
*H01Q 9/40* (2006.01)
(Continued)

(52) U.S. Cl.
CPC ..... *H01Q 9/40* (2013.01); *H01Q 1/32* (2013.01); *H01Q 1/3275* (2013.01); *H01Q 1/38* (2013.01);
(Continued)

(58) Field of Classification Search
CPC .. H01Q 9/40; H01Q 1/32; H01Q 1/38; H01Q 5/378; H01Q 9/36; H01Q 9/42; H01Q 1/3275
See application file for complete search history.

(56) References Cited

U.S. PATENT DOCUMENTS 4,038,662 A * 7/1977 Turner ..... H01Q 9/065 343/752
4,571,595 A * 2/1986 Phillips ..... H01Q 1/243 343/702
(Continued)

FOREIGN PATENT DOCUMENTS

EP 1372216 A2 12/2003
EP 1445828 A2 8/2004
(Continued)

OTHER PUBLICATIONS

International Search Report for related International Application No. PCT/EP2015/071294; dated Dec. 4, 2015; 3 pages.

*Primary Examiner* — Tho G Phan
(74) *Attorney, Agent, or Firm* — Cantor Colburn LLP

(57) ABSTRACT

The invention relates to a vertical broadband monopole antenna for vehicles, for two frequency bands separated by a frequency gap, said antenna having a first capacity top and a further capacity top, which is capacitively coupled to the first capacity top, wherein the further capacity top has at least one inductive high-resistance conductive strip, which extends to a conductive ground surface and is conductively connected thereto at its lower end.

26 Claims, 26 Drawing Sheets

Figure 1:
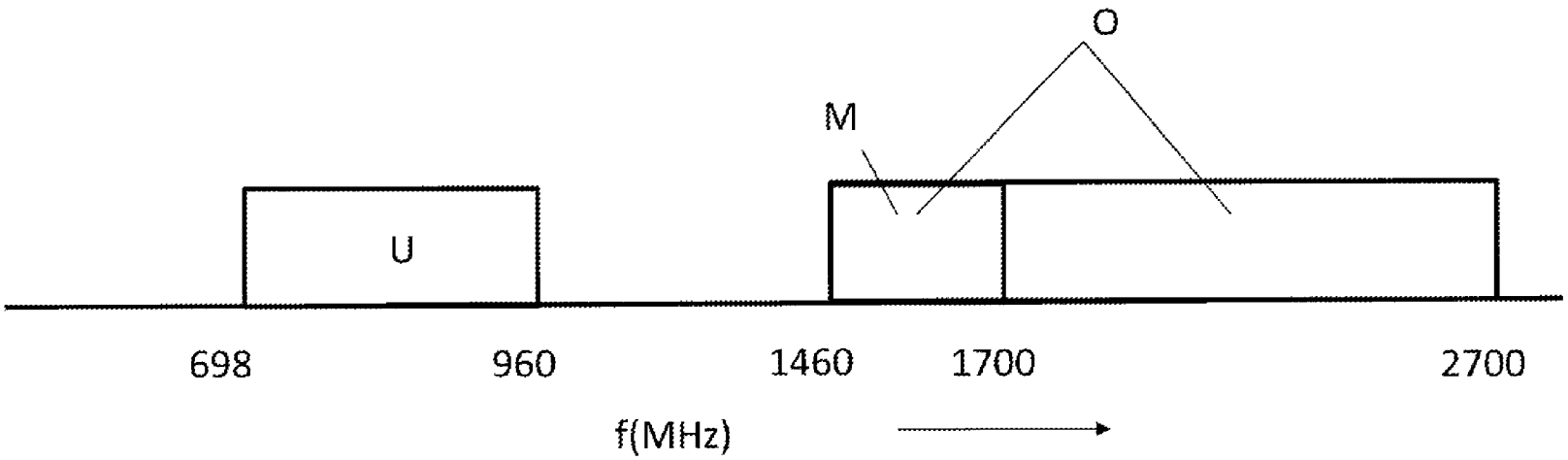

(51) Int. Cl.

| | |
|---|---|
| ***H01Q 1/38*** | (2006.01) |
| ***H01Q 9/36*** | (2006.01) |
| ***H01Q 9/42*** | (2006.01) |
| ***H01Q 5/378*** | (2015.01) |

(52) U.S. Cl.
CPC ..... *H01Q 5/378* (2015.01); *H01Q 9/36* (2013.01); *H01Q 9/42* (2013.01)

(56) References Cited

U.S. PATENT DOCUMENTS

| | | | | |
|---|---|---|---|---|
| 4,764,773 | A * | 8/1988 | Larsen | H01Q 1/1285 333/25 |
| 4,864,320 | A * | 9/1989 | Munson | H01Q 19/06 343/833 |
| 6,853,341 | B1 * | 2/2005 | Hellgren | H01Q 1/3275 343/742 |
| 8,223,086 | B2 * | 7/2012 | Hansen | H01Q 1/32 343/700 MS |
| 9,553,365 | B2 * | 1/2017 | Lindenmeier | H01Q 1/3275 |

FOREIGN PATENT DOCUMENTS

| | | | |
|---|---|---|---|
| EP | 1732162 | A1 | 12/2006 |
| GB | 2317994 | A | 4/1998 |
| JP | 2005057438 | A | 3/2005 |
| WO | 9624963 | A1 | 8/1996 |
| WO | 2004025778 | A1 | 3/2004 |

* cited by examiner 6
20b
4b
51
38,42
32
49
50
48
43
40
39
y
z
7
47
15
41
3
10, 16
50
1
49
20a
5
4a
x

MULTI-STRUCTURE BROADBAND MONOPOLE ANTENNA FOR TWO FREQUENCY BANDS IN THE DECIMETER WAVE RANGE SEPARATED BY A FREQUENCY GAP, FOR MOTOR VEHICLES

CROSS REFERENCE TO RELATED APPLICATIONS

This application is a National Phase Application of Patent Application PCT/EP2015/071294 filed on 17 Sep. 2015, which claims priority to DE102014013926.3, filed 21 Sep. 2014, both of which are hereby incorporated by reference in their entirety.

The invention relates to a vertical broadband monopole antenna for two frequency bands separated by a frequency gap—the lower band for the lower frequencies and the upper band for the higher frequencies—both disposed in the decimeter wave spectrum—for vehicles and for transmitting and/or receiving using terrestrially broadcast, vertically polarized radio signals over a substantially horizontal conductive base surface 6 as a vehicle ground having an antenna connection site 3 located in the monopole nadir and comprising an antenna connection point 5 and a ground connector 7.

Such broadband antennas are known from the prior art. These antennas are configured as multi-resonant rod antennas, wherein the coverage of a plurality of frequency bands separated from one another in frequency by frequency gaps takes place using multiple wire windings which are applied to the elongate rod and which partly overlap. Such antennas are used for transmitting and receiving in the decimeter wave spectrum on vehicles, preferably on the vehicle roof in each case. Antennas of this kind have the disadvantage, on the one hand, that they are only provided for relatively narrow band frequency bands separated from one another by frequency gaps and are only considered for wide frequency bands with great limitations. The construction height, their aerodynamic shape and their resistance value are in particular of importance for the use on vehicles. What is of special importance, however, is the economy of manufacture of such an antenna due to the large volumes customary in automotive construction. It has been shown in this respect that the application of different wire windings mechanically has to be subject to very tight tolerances for the required frequency precision to be achieved. Furthermore, the application of the windings to the rod, their fastening and the establishing of their long term resistance and the reproducibility of the performance capability of the antenna are comparative complicated and economically expensive.

The high number of modern cellular networks such as configured in accordance with the mobile communication standard LTE (long term evolution) or still in development requires antennas having extreme bandwidths. For example, a frequency range between 698 and 960 MHz—called lower band U in the following—is provided for the LTE mobile communication standard and the frequency range called the upper band O here between 1460 MHz and 2700 MHz is provided above a frequency gap, as shown in FIG. 1. A middle band M in the frequency range between 1460 MHz and 1700 MHz is frequently additionally provided which is to be associated with the upper band. With respect to the antenna function, the frequency gap between the lower band U and the upper band O is desired for protection against the radio services located there. Antennas are required for this application which are suitable for vehicles, in addition to the electrical function, with economy of manufacture having a special importance.

It is therefore the object of the invention to provide an antenna for two frequency bands separated by a frequency gap which can be manufactured economically with less effort with a small construction height and favorable aerodynamic properties, above all in a simple manufacturing process by special shaping and without a matching network and having concentrated components.

This object is satisfied by the features of claim 1.

Advantageous embodiments of the invention are set forth in the dependent claims, in the description and in the drawings.

The antenna can comprise a vertical broadband monopole antenna for two frequency bands separated by a frequency gap—the lower band for the lower frequencies and the upper band for the higher frequencies—both lying in the decimeter wave spectrum—for vehicles and for transmitting and/or receiving using terrestrially broadcast, vertically polarized radio signals over a substantially horizontal conductive base surface 6 as a vehicle ground having an antenna connection site 3 located in the monopole nadir and comprising an antenna connection point 5.

The broadband monopole antenna 0 can be formed from an upper band monopole 1 and a lower band monopole combined and is, for example, formed from a first structure and a further structure, with both structures being able to be respectively configured, in particular not connected to one another, from a mechanically stiff electrically conductive foil 33 as a contiguous electrically conductive and, for example, areal structure over a conductive base surface 6 extending substantially in a plane oriented perpendicular thereto. The antenna can in this respect also be called a multistructure broadband monopole antenna.

A triangular structure 4 standing at its apex and areal, for example, can be present at the lower end of the first electrically conductive structure of the multistructure broadband monopole antenna 0 as an upper band monopole 1 having a substantially horizontally oriented baseline in an upper band monopole height 8 above the conductive base surface 6 whose apex is connected to the antenna connection point 5.

A first roof capacitor 10 is substantially configured as a first rectangular structure 16, in particular as an areal rectangular structure, adjacent to and below the upper end of the first electrically conductive structure of the multistructure broadband monopole antenna 0 located at the antenna height 9 above the conductive base surface 6. The roof capacitor or the first rectangular structure is therefore located beneath the upper end of the antenna.

The triangular structure 4 and the first rectangular structure 16 as the first roof capacitor 10 are inductively connected with high impedance by at least one first conductor strip 15 having an in particular narrow strip conductor width 14 of, for example, smaller than or equal to 7 mm for the separation of radio signals in the upper band, whereby substantially a first part of the lower band monopole 2 is formed.

A vertical multistructure broadband monopole antenna for vehicles for two frequency bands, namely a lower band U for lower frequencies and an upper band O for higher frequencies, separated by a frequency gap and both disposed in the decimeter wave spectrum, is disclosed for transmitting and/or receiving using terrestrially broadcast, vertically polarized radio signals over a substantially horizontal conductive base surface 6 as a vehicle ground having an antenna connection site 3 located in the nadir of the first conductive structure comprising the following features:

The multistructure broadband monopole antenna is configured from at least two structures, in particular self-supporting electrically conductive structures that are oriented above a substantially perpendicular to the base surface 6.

The first electrically conductive structure can comprise at the lower end of the multistructure broadband monopole antenna a triangular structure 4 standing on its apex and having a substantially horizontal baseline, the apex forming an antenna connection point 5 of the antenna connection site 3. The first electrically conductive structure comprises, adjacent to and disposed beneath the upper end of the multistructure broadband monopole antenna 0, a first roof capacitor 10 substantially designed as a first rectangular structure 16. The triangular structure 4 and the first rectangular structure 16 are inductively connected with high impedance by at least one first conductor strip 15, 15*a* for separating radio signals in the upper band O.

The first electrically conductive structure can have at least two spaced apart first conductor strips 15, 15*a*, whereby a frame structure 11 is formed comprising the triangular structure 4, the first rectangular structure 16, and the first conductor strip 15, 15*a*.

The first conductor strip or strips 15, 15*a* can contain meandering shapes 24 for a frequency-selective separation.

The internal angle 12 at the apex of the triangular structure 4 can amount to between 30 and 90 degrees, for instance.

The triangular structure 4 can also be configured by strip-shaped lamellas 20 arranged fan-like and running together at the apex in the triangle plane.

To improve the electromagnetic decoupling, the first rectangular structure 16 can substantially be formed by strip-shaped roof lamellas 19, 19*a*, 19*b* which extend vertically electrically conductively separately from one another, but contiguous at their upper end via a remaining strip 31.

The strip-shaped lamellas 30, 30*a*, 30*b* which run together in the apex can be angled out of the plane of the triangular structure 4 such that they extend substantially on the jacket surface of a cone standing on its apex and having a circular or elliptical cross-section.

The roof lamellas 19 can be angled in opposite senses following one another in a manner such that they are arranged in V shape in a projection onto a plane extending transversely to the strip 31.

The lamellas 20*a*, 20*b* running together at the apex can be angled in opposite senses following one another from the plane of the triangular structure 4 such that they are arranged in V shape in a projection onto a plane extending transversely to the triangular structure 4.

A coupling conductor 35 can be present which is connected at its upper end to the first roof capacitor 10 and which is coupled at its lower end to the conductive base surface 6.

The further electrically conductive structure comprises a further roof capacitor 38 that is designed substantially as a rectangular structure 42 in the embodiment shown and that is guided substantially in parallel with the first rectangular structure 16 for a capacitive coupling to the first roof capacitor 10 at an roof capacitor coupling spacing 40. The roof capacitor coupling spacing 40 is smaller than 1/30 of the free progressive wavelength λ at the lowest frequency of the lower band U.

The further electrically conductive structure comprises at least one further conductor strip 39 of inductively high impedance for separation of radio signals in the upper band O that is connected to the further areal structure 42 and that extends to the conductive base surface 6 and is conductively connected thereto at its lower end.

The further electrically conductive structure can be configured in a manner such that two further conductor strips 39, 39*a* are present of which each is connected—disposed opposite one another—to the further roof capacitor 38 in the proximity of a respective one of the lateral ends and is guided at a spacing from the side margin of the triangular structure 4 while avoiding an overlap of the triangular structure 4 to the conductive base surface 6 and is conductively connected thereto at its lower end.

The further conductor strip(s) 39, 39*a* can contain meandering shapes 24 for the frequency-selective separation.

At least one of the further conductor strips 39, 39*a* can be guided at a conductor strip coupling spacing 41 substantially in parallel with a respective first conductor strip 15, 15*a* and can be conductively connected at its lower end to the conductive base surface 6.

The impedance matching at the antenna connection site 3 can be given in the lower frequency range of the lower band U by selecting the inductance of the first conductor strip or strips 15, 15*a* or of the further conductive strip or strips 39, 39*a*, by selecting the strip conductor width 14 and/or by adding meandering shapes 24 as well as by selecting the roof capacitor coupling spacing 40 and or the horizontal and vertical extents 23, 23*a* of the first rectangular structure 16 or of the further areal structure 42 and by selecting the conductor strip coupling spacing 41.

The first electrically conductive structure and the further electrically conductive structure can each comprise electrically conductive sheet metal and a self-supporting firs conductor strip 15 whose strip conductor width 14 is in particular smaller than or equal to 7 mm can be present in the first electrically conductive structure.

The first electrically conductive structure can, however, also be given by a metallic coating 33 on a first side of a circuit board and the further electrically conductive structure can be given on the second side of this circuit board, and the antenna connection site 3 of the multistructure broadband monopole antenna 0 at the lower end of the circuit board can preferably be designed as a plug-in connection 45 having a ground connection point 7 and a base surface connection point 43, 44 at the conductive base surface 6.

Both structures can also only be implemented on one side of a circuit board by configuration of interdigital structures for the implementation of the first roof capacitor 10 and of the further roof capacitor 38 that engage into one another in the manner of a comb.

If a ring-shaped satellite reception antenna 25 arranged concentrically to the antenna connection site 3 is present, both the first rectangular structure 16 and the further areal structure 42 designed as a further rectangular structure can be formed, for the improvement of the electromagnetic decoupling, substantially by strip-shaped roof lamellas 19, 19*a*, 19*b* that extend vertically electrically conductively separately from one another, but are contiguous at their upper ends via a remaining strip 31.

The multistructure broadband monopole antenna 0 can be arranged beneath a cover hood 32 and the at least one first conductor strip 15, 15*a* can be guided at least in part and in particular as far as possible along the inner wall of the cover hood.

The mirror image of the broadband monopole antenna 0 at the conductive base surface 6 can be replaced on its being dispensed with by a further multistructure broadband monopole antenna which is the same as it in a manner such that a dipole is present symmetrical to the plane of the conductive base surface 6 and a symmetrical antenna connection site of this dipole is formed between the antenna connection point 5 of the broadband monopole antenna 0 and the antenna connection point 5 of the further multistructure broadband monopole antenna—which corresponds to it—and is mirrored at the conductive base surface 6.

The upper band monopole 1 can be formed by two areal triangular structures 4*a*, 4*b* whose surface normals are disposed in the same plane—e.g. the x-z plane of a coordinate system—as the surface normal of the first rectangular structure 16 in a manner such that the strip-shaped lamellas 20*a*, 20*b* originating from the antenna connection site 5 located at the origin of the coordinate system (from which the center axis Z starts) are angled out of the y-z plane—split into lamellas 20*a* in the direction of the positive x axis and into lamellas 20*a* in the direction of the negative x axis—in each case by a deflection angle 49 such that the upper band monopole 1 is substantially formed by two triangles 4*a* and 4*b* standing on their apices.

The two triangular structures 4*a* and 4*b* of the upper band monopole 1 can be formed from contiguous conductive layers.

The multistructure broadband monopole antenna 0 can be attached to the vehicle in a manner such that the horizontal extent of the areal roof capacitor 10 extends in the line of the direction of travel.

The strip-shaped lamellas 20 of the upper band monopole 1 running together in the bottom triangle apex are angled out of the plane of the areal triangular structure 4 following one another in a manner such that they are arranged in V shape in the projection onto a plane disposed transversely to the direction of travel.

The triangles 4*a* and 4*b* with their triangle apices angled out by the deflection angle 49 can be mutually offset by an offset length 50 approximately symmetrically to the antenna connection point 5 in the x direction and can be connected to one another via a short connection conductor 48 guided over a small base surface spacing 51 in parallel with the x axis, starting from which connection conductor the antenna connection point 5 can be formed.

A coupling conductor 35 can be present that is inductively connected with high impedance to the first roof capacitor 10 at least in the frequency range of the upper band O and that is electrically conductively connected at its lower end to the conductive base surface 6.

The coupling spacing for the capacitive coupling of the further roof capacitor can be $\lambda/30$, wherein in particular a roof capacitor coupling spacing $<\lambda/30$ can be advantageous at the lowest frequency of the lower band U that occurs.

It can be advantageous if the further electrically conductive structure is configured in a manner such that the further conductor strip is connected to the further roof capacitor in the region of one of the side ends and is guided to the conductive base surface 6 at a conductor strip coupling spacing from the side margin of the triangular structure while avoiding the overlap of the triangular structure of the first electrically conductive structure.

In accordance with a further advantageous embodiment, an impedance matching takes place at the antenna connection site of the first structure in the lower frequency range of the lower band U by a selection of the inductance of the first conductor strip or strips or of the further conductor strip or strips by selecting the strip conductor width and/or by inserting meandering shapes as well as by a selection of the roof capacitor coupling spacing and/or of the horizontal and vertical extents of the first rectangular structure or of the further rectangular structure and by selecting the conductor strip coupling spacing.

The first electrically conductive structure and the further electrically conductive structure can each comprise electrically conductive sheet metal and an in particular self-supporting first conductor strip whose strip conductor width is in particular smaller than or equal to 7 mm can be present in the first electrically conductive structure.

In particular when a ring-shaped satellite reception antenna arranged concentrically to the antenna connection site is present, the first rectangular structure and/or the further rectangular structure and/or the triangular structure can essentially be formed, for improving the electromagnetic decoupling, substantially by strip-shaped lamellas that extend electrically conductively separately from one another, but are contiguous at their ends.

The lamellas can be angled out in opposite senses following one another in a manner such that they are arranged in V shape in a projection onto a plane extending transversely to the remaining strip.

A test conductor can be connected to a high-impedance DC current resistor between the first conductive structure and the further conductive structure, preferably between the conductive rectangular structure and the further rectangular structure, for the purpose of the connection test of the antenna, with this test conductor being able to be of sufficiently high impedance with respect to the function of the antenna both in the lower band U and in the upper band O.

The broadband monopole antenna 0 can be attached to the vehicle in a manner such that the horizontal extent of the areal roof capacitor extends in the direction of travel.

Strip-shaped lamellas of the upper band monopole running together in a bottom triangle apex can be angled out of the plane of the areal triangular structure following one another in a manner such that they are arranged in V shape in the projection onto a plane disposed transversely to the direction of travel.

In a further advantageous embodiment of the invention, the areal structure of the further roof capacitor can be configured by an electrically conductive conductor strip that extends in a surface in parallel with the first rectangular structure at the roof capacitor coupling spacing and that can in particular also be meandering form.

Figure 2:
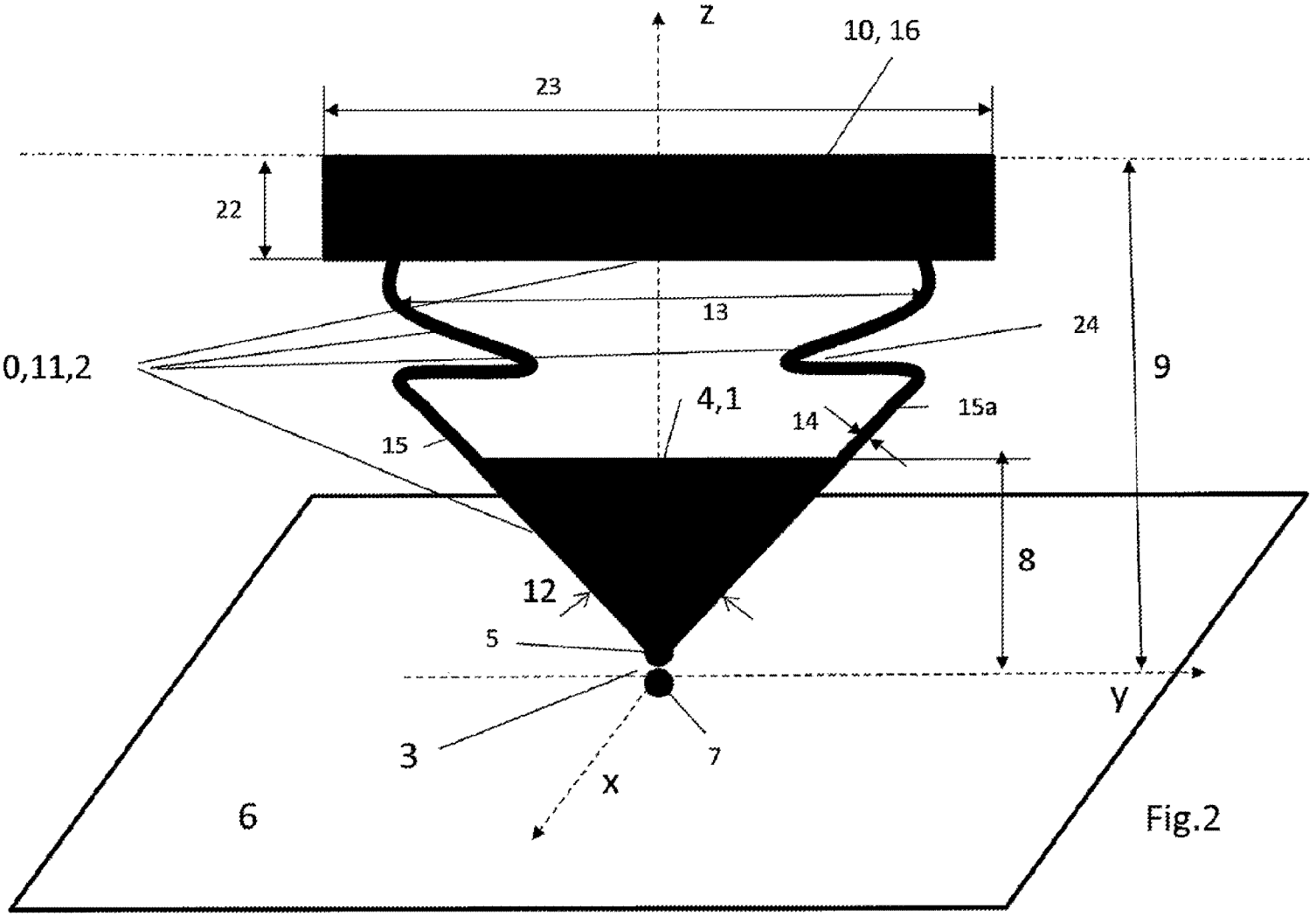
Figure 3:
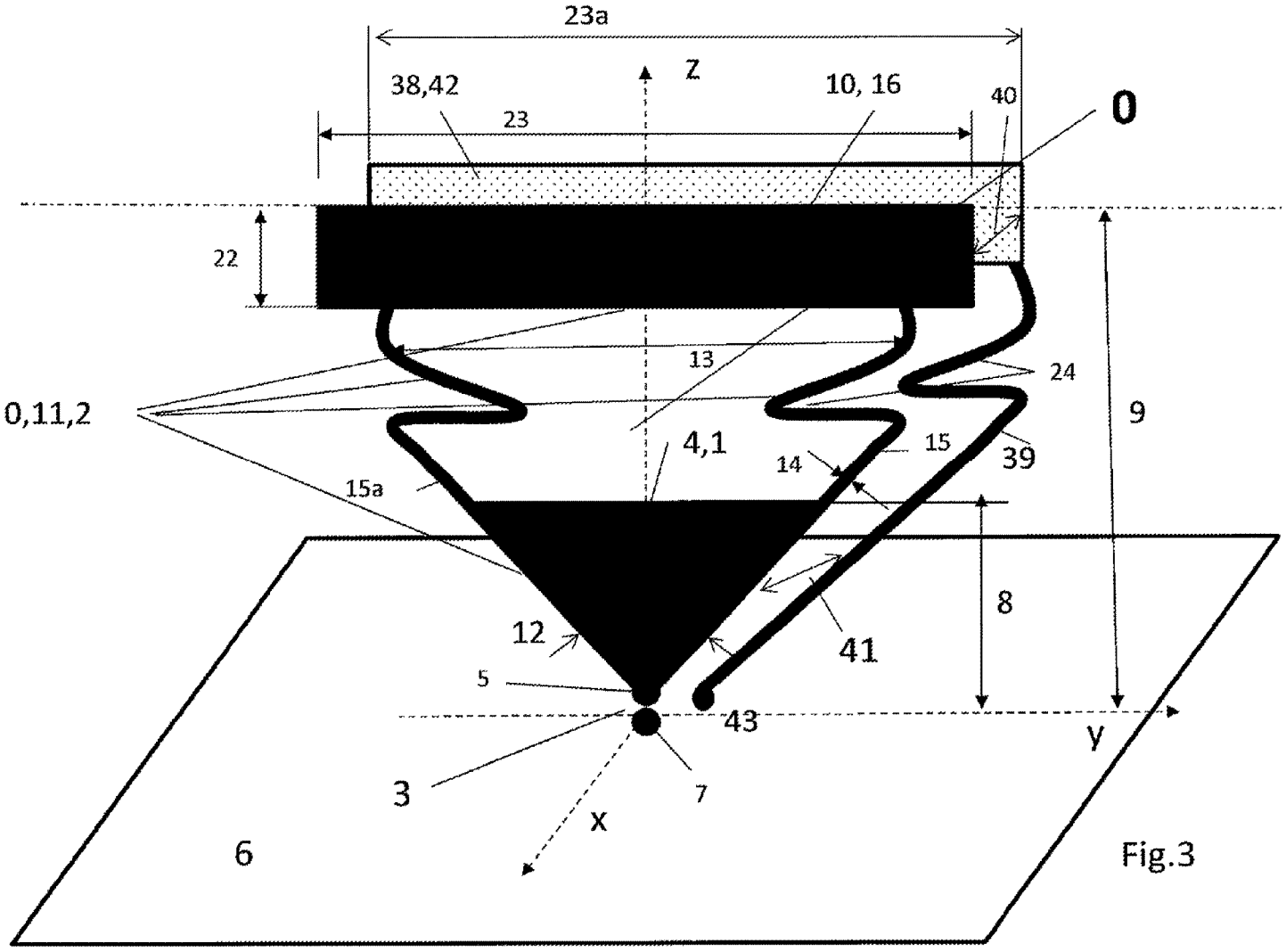

The invention will be explained in more detail in the following with reference to embodiments. The associated Figures show in detail:

FIG. 1: frequency ranges in accordance with the LTE mobile communication standard as an example for two frequency bands in the decimeter wave spectrum which are separated by a frequency gap and have a frequency range between 698 and 960 MHz as a lower band U and a frequency range between 1460 MHz and 2700 MHz as an upper band O above a frequency gap;

FIG. 2: a two-dimensional first electrically conductive structure of the multistructure broadband monopole antenna 0 in accordance with the invention above the electrically conductive base surface 6 and the antenna connection site 3 formed at the nadir having an areal flat triangular structure and standing on its apex as an upper band monopole 1 and the first roof capacitor 10 which are connected via two first two conductor strips 15 having a meandering shape 24 to the triangular structure 4 for forming the first part of the lower band monopole 2. A frame structure 11 comprising the triangular structure 4, the first rectangular structure 16, and the first conductor strip 15, 15*a* is thus formed. The structure of the multistructure broadband monopole antenna 0 can be stamped or cut in full from sheet metal by way of example or printed onto a circuit board;

FIG. 3: a multistructure monopole antenna 0 in accordance with the invention comprising the first electrically conductive structure as in FIG. 2, combined with the further electrically conductive structure; wherein the further roof capacitor 38 in the form of the further rectangular structure 42 is guided at a roof capacitor coupling distance 40 substantially in parallel with the first rectangular structure 16 of the first structure and the further rectangular structure 42 is connected to the conductive base surface 6 at the base surface connection point 43 via the further conductor strip 39 extending toward the conductive base surface 6 and having a meandering shape 24. The lower band monopole 2 is completely formed by the combination of the first conductive structure and of the further conductive structure.

Figure 4:
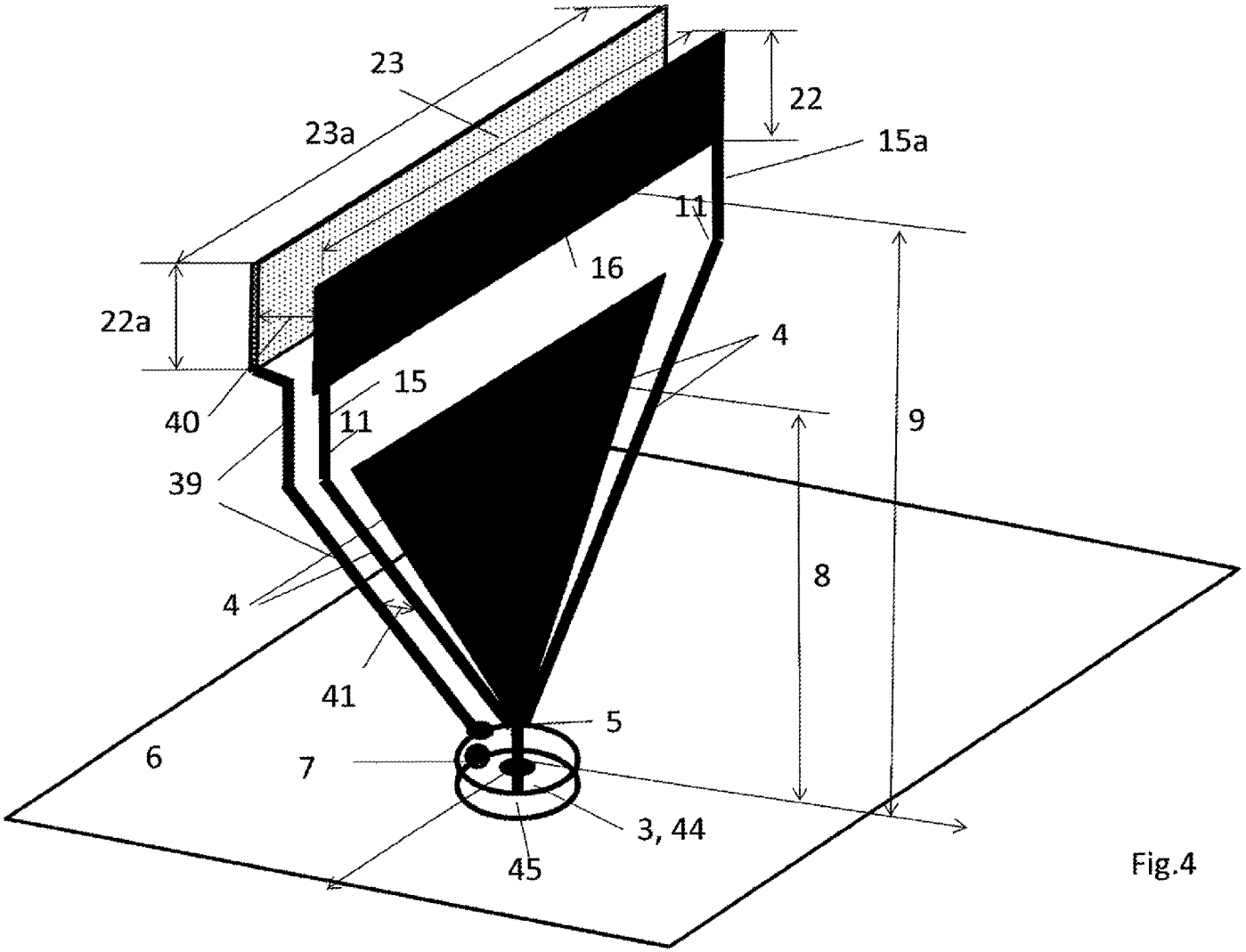
Figure 5A:
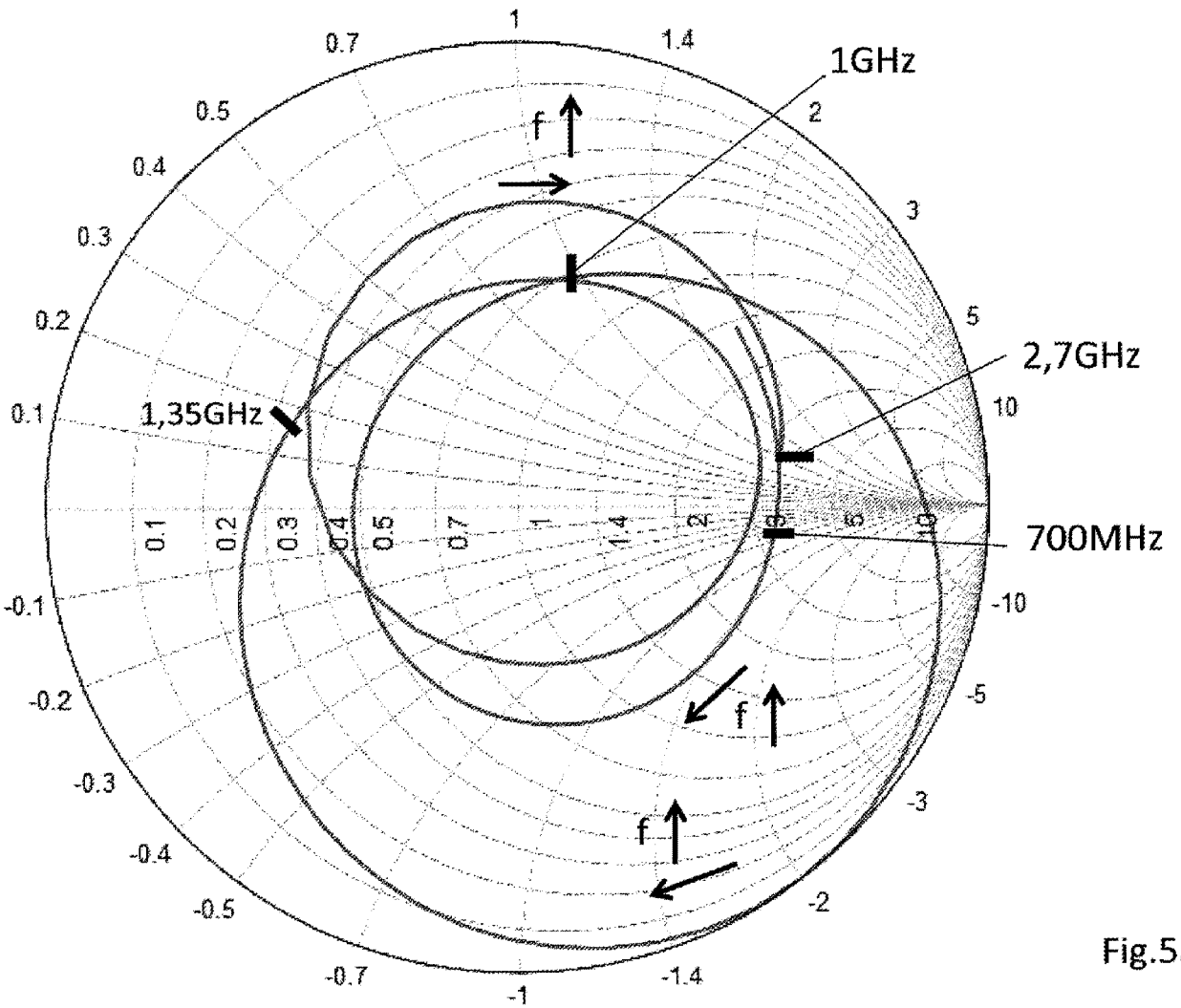
Figure 5C:
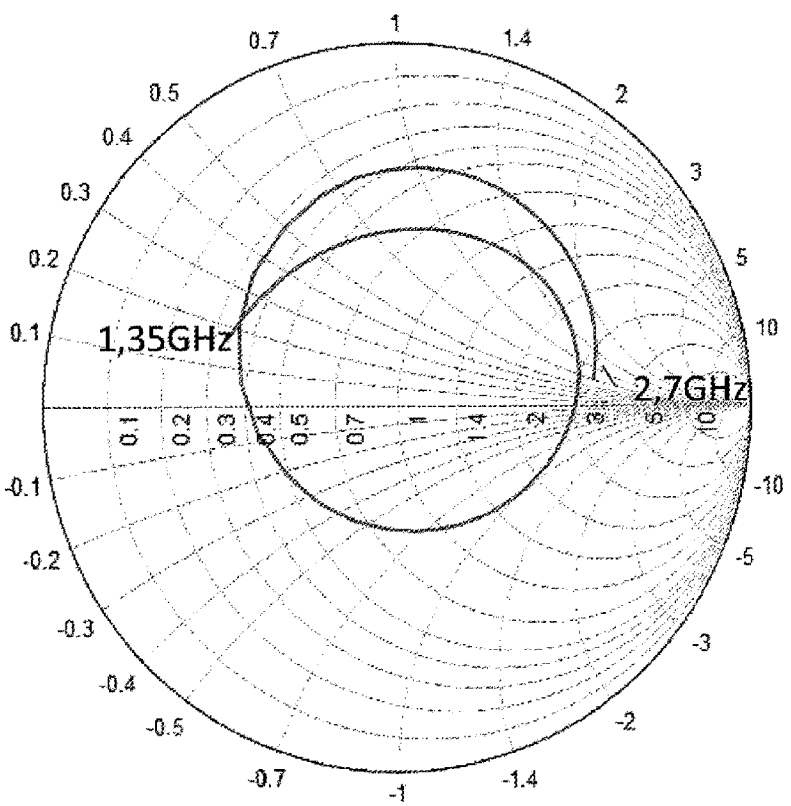
Figure 5B:
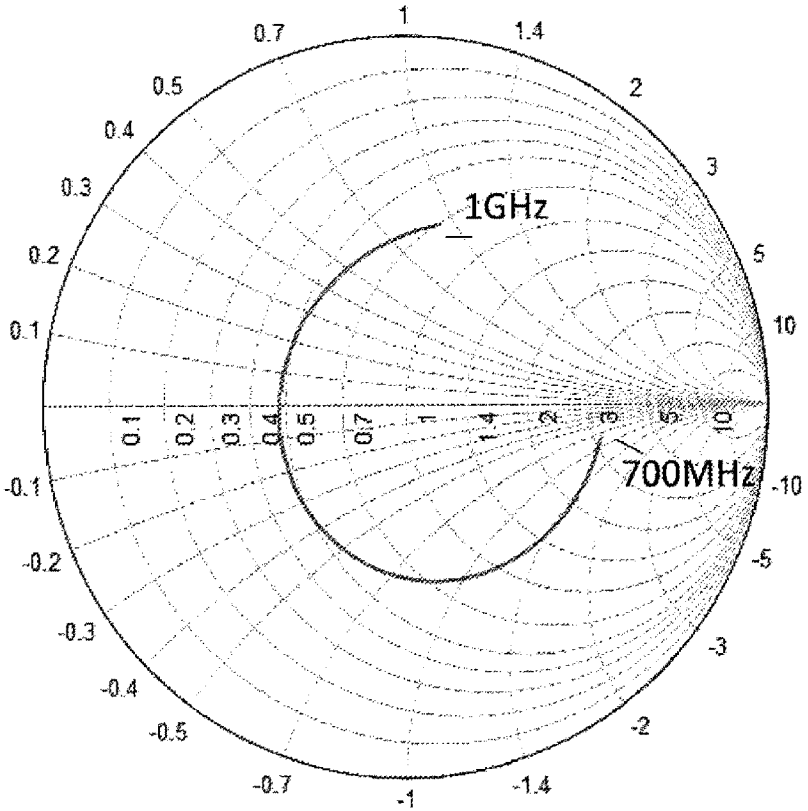
Figure 5D:
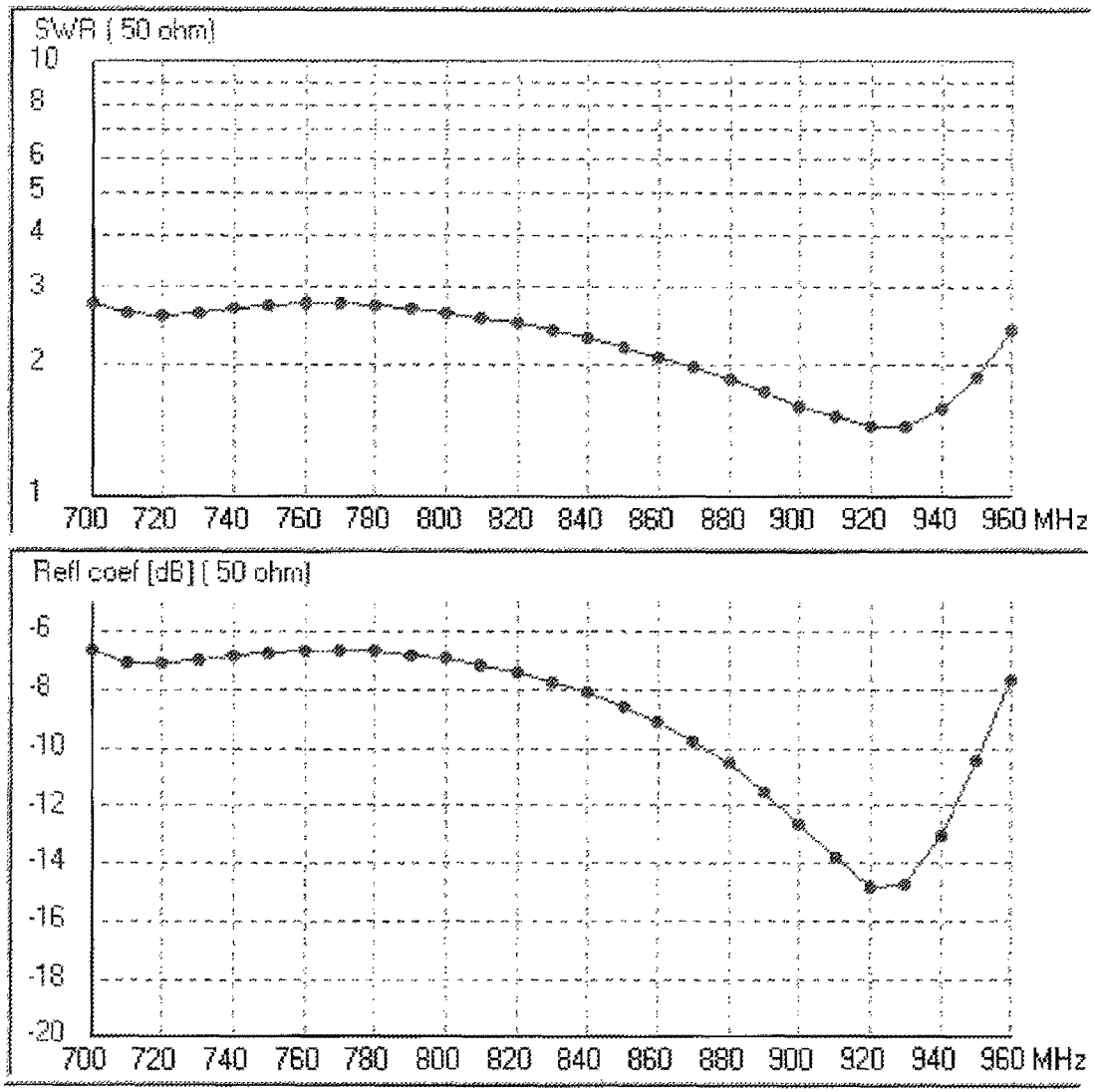
Figure 5E:
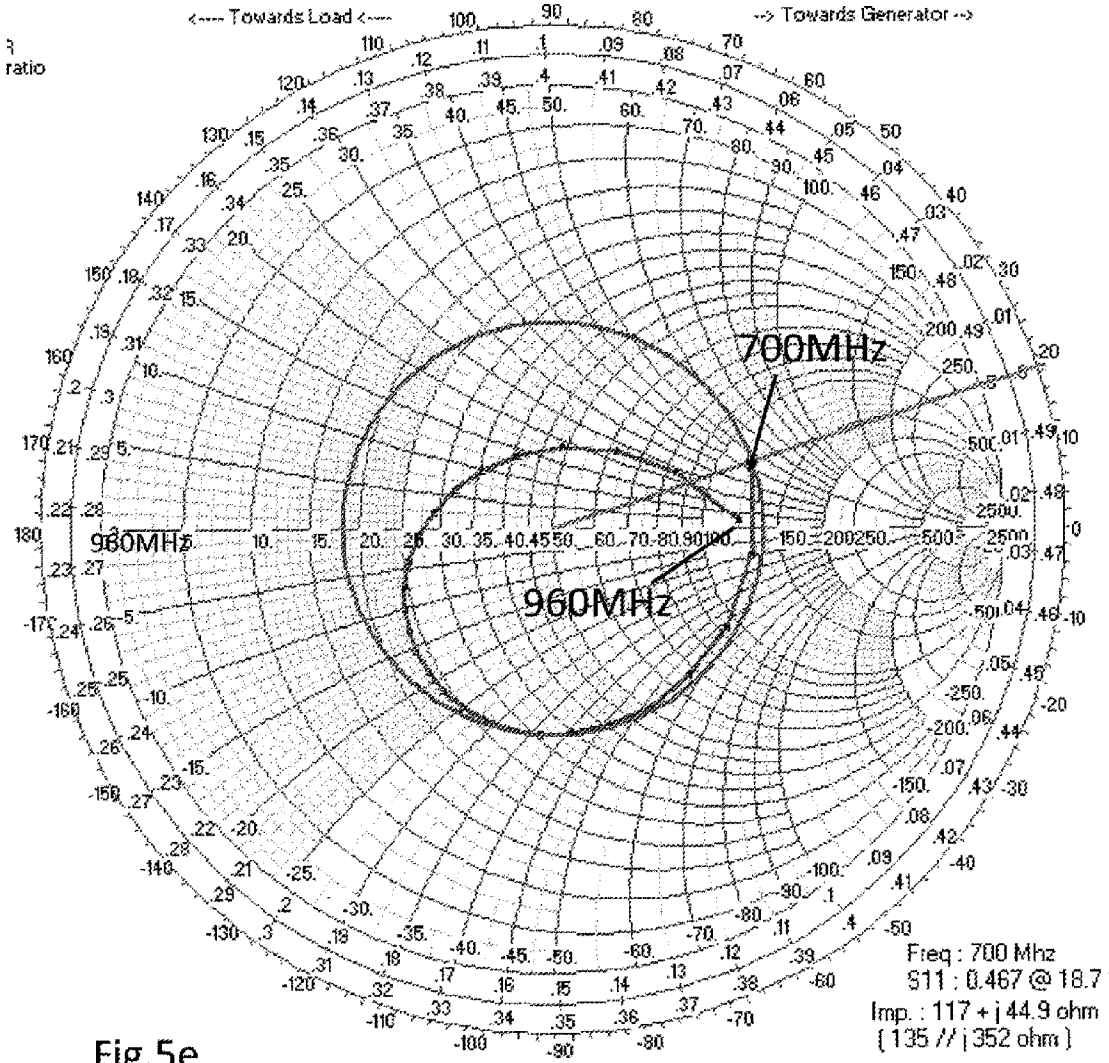
Figure 6:
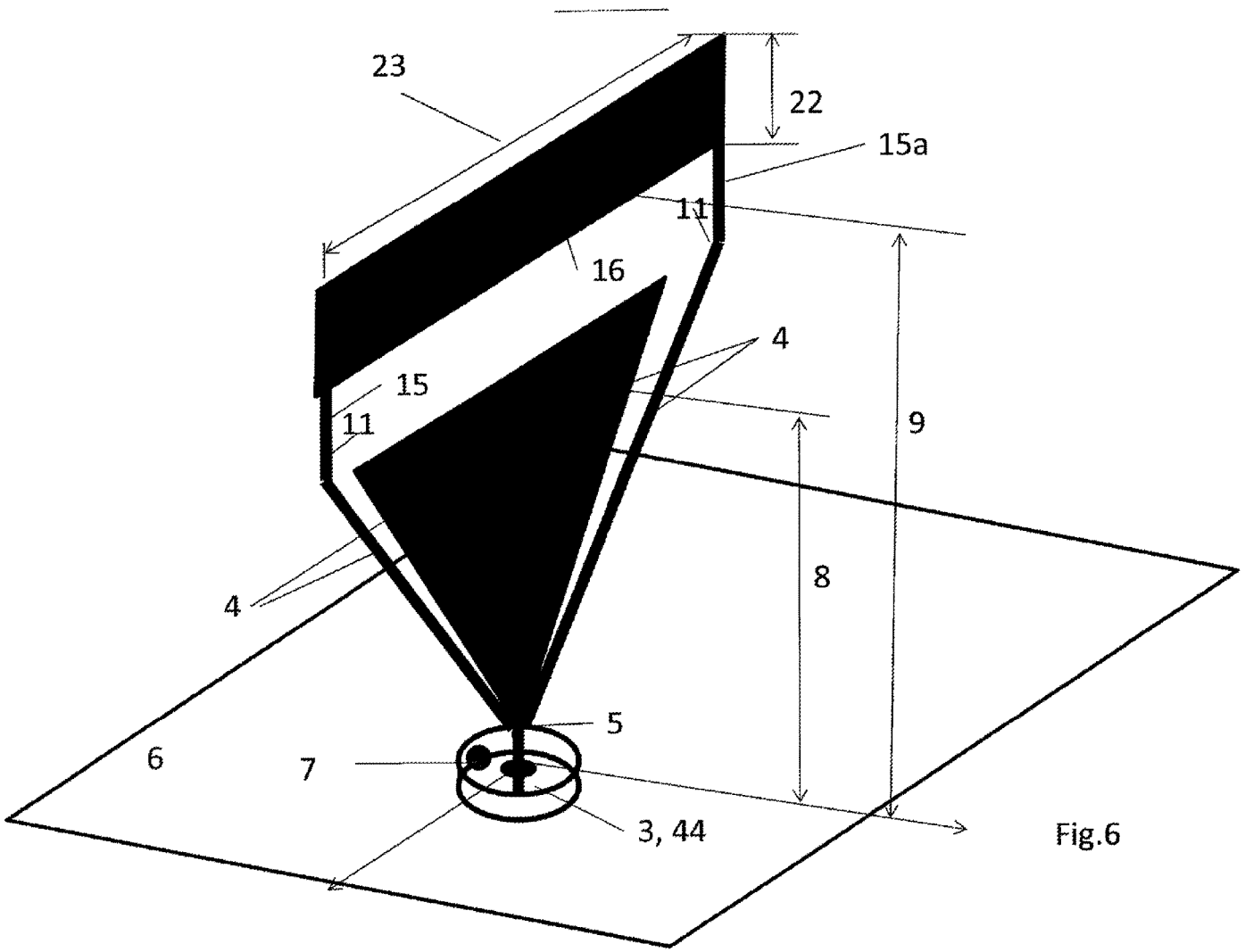
Figure 7A:
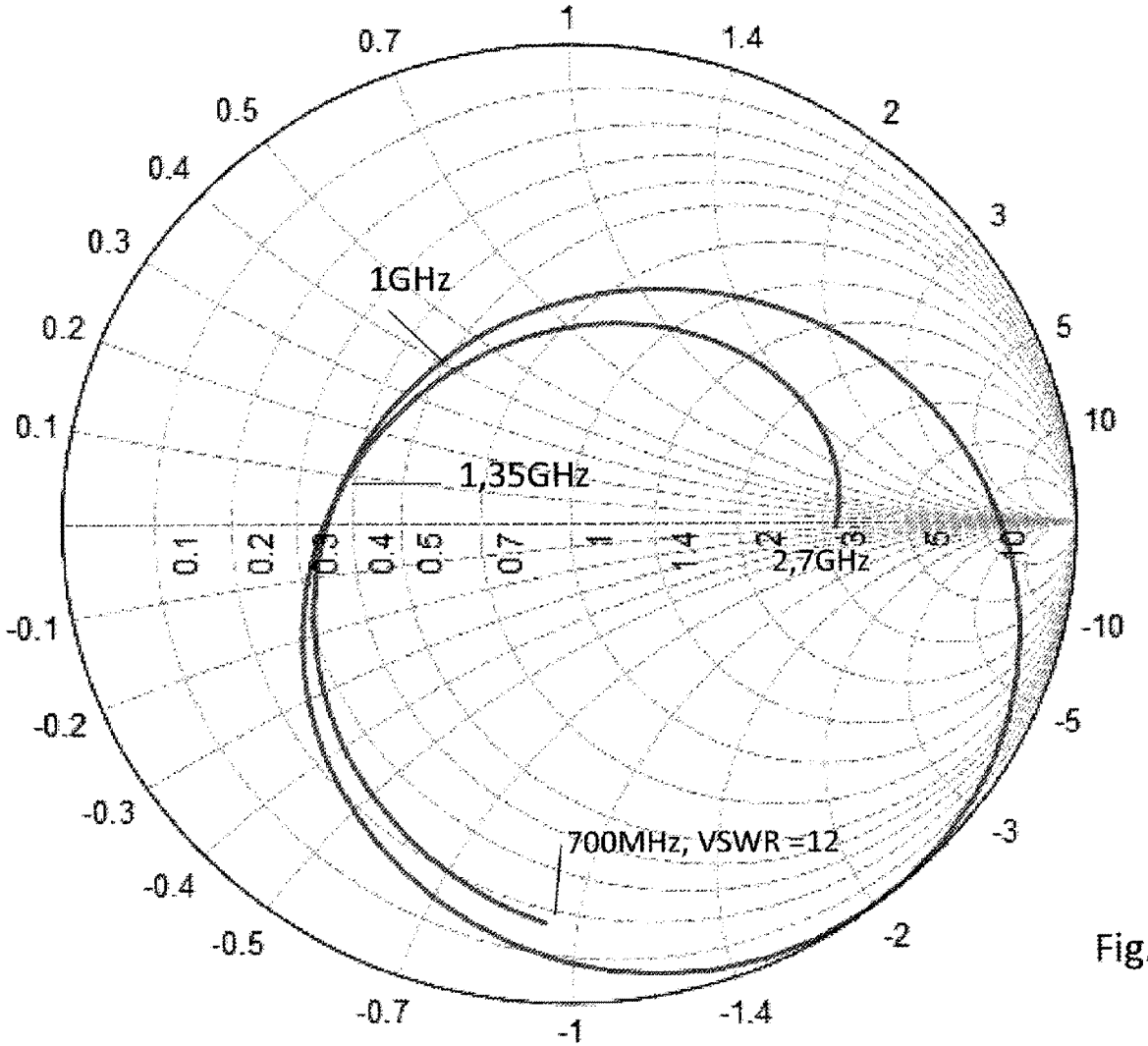

FIG. 4: a multistructure broadband monopole antenna 0 in accordance with the invention having a first electrically conductive structure as in FIG. 3, wherein the vertically extending outer sides of the triangular structure 4 are fanned out from the contiguous electrically conductive central part above the apex of the triangle and are designed as conductor strips and wherein they are continued as conductor strips 15, 15*a* above the triangular structure 4 and are connected to the first rectangular structure 16, whereby a frame structure 11 is formed. The further rectangular structure 42 of the further electrically conductive structure is, as in FIG. 3, arranged at the roof capacitor coupling spacing 40 in parallel with the first rectangular structure 16 and the further conductor strip 39 is guided at the conductor strip coupling spacing 41 substantially in parallel with the first conductor strip 15. By setting the roof capacitor coupling spacing 40, the conductor strip coupling spacing 41 and by selecting the horizontal extent 23*a* and the vertical extent 22*a* of the further roof capacitor 38, an impedance matching is achieved at the antenna connection site 3 or at the coaxial plug-in connection 44 located there without any additional electrical components, in particular also at the lower end of the lower frequency band U;

FIG. 5: a) an extremely broadband extent of the impedance at the antenna connection site 3 of a multistructure broadband monopole antenna 0 of 4.5 cm height in accordance with the invention (as in FIG. 4) for the frequency range of the lower band U (700 MHz to 1 GHz) and of the upper band O (here with 1.35 GHz to 2.7 GHz) as well as of the frequency gap between 1 GHz and 1.35 GHz in the complex impedance plane related to Z0=50 ohms;

b) impedance curve as in Figure a), but only for the frequency range of the lower band U (700 MHz to 1 GHz) for better clarity. The matching value is also VSWR <3.5 at the lowest frequencies. The impedance curve shows the tendency of the enlacement of the matching point which can be achieved by the combination of the two structures via the capacitive coupling of the first and further roof capacitors and of the first and further conductor strips;

c) impedance curve as in Figure a), but only for the frequency range of the upper band O (here with 1.35 GHz to 2.7 GHz) for better clarity;

d) exemplary curve of the VSWR of a multistructure broadband monopole antenna 0 in accordance with the invention in the frequency range of the lower band U. The combination of the structures in accordance with the invention allows the often demanded condition of VSWR <3 to be satisfied with an antenna height 9 of only 52 mm, that is at 700 MHz a relative antenna height of 12%—and with a horizontal extent 23 of the first roof capacitor 10 of only 30 mm;

e) impedance curve in accordance with the VSWR curve of the multistructure broadband monopole antenna 0 described under d). The impedance curve in the total frequency range is between 700 MHz and 960 MHz within the shown circle for VSWR=3;

FIG. 6: example of a monopole antenna in the form of a singularly standing first structure of the multistructure broadband monopole antenna 0 cited in FIG. 5 in accordance with the invention for describing the influence of the further structure electromagnetically coupled to the first structure on the curve of the impedance in FIGS. 7 *a-c;*

Figure 23:
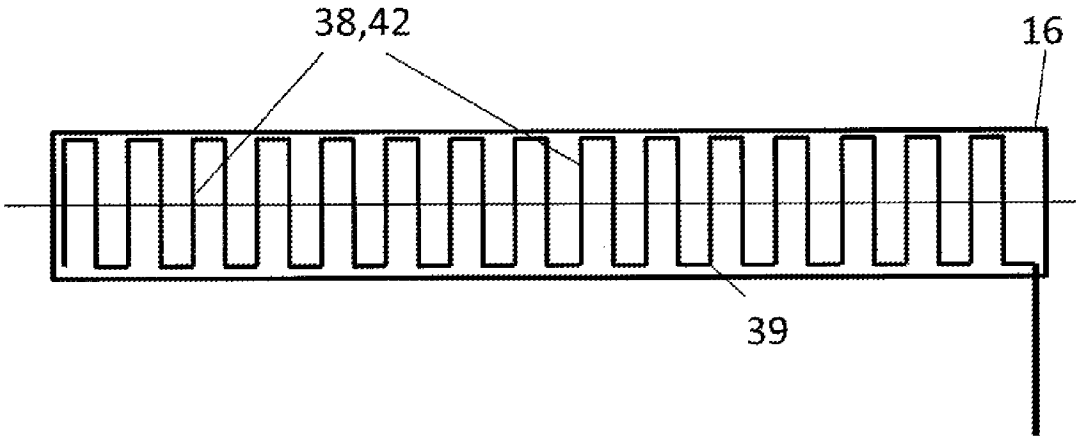
Figure 8:
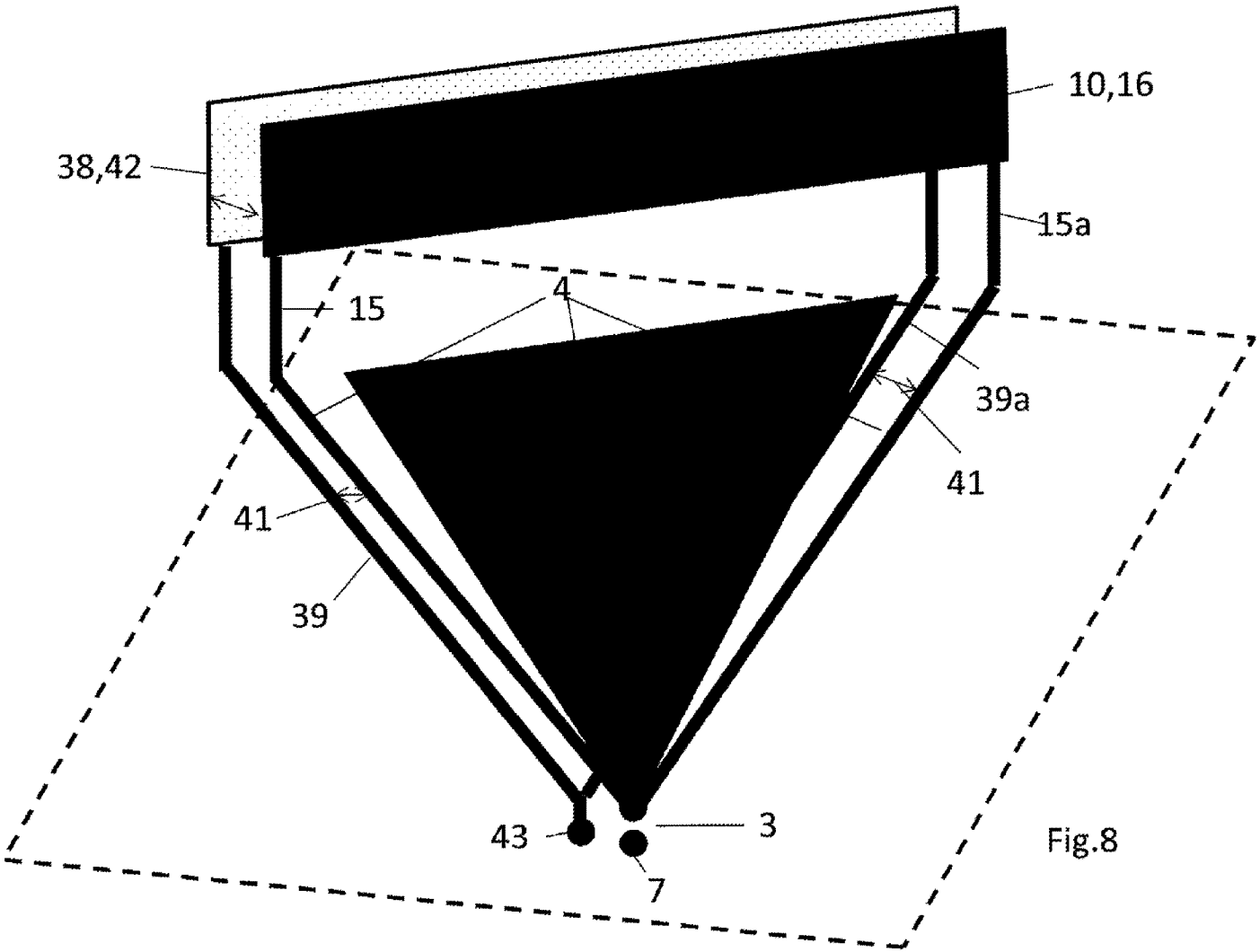
Figure 9:
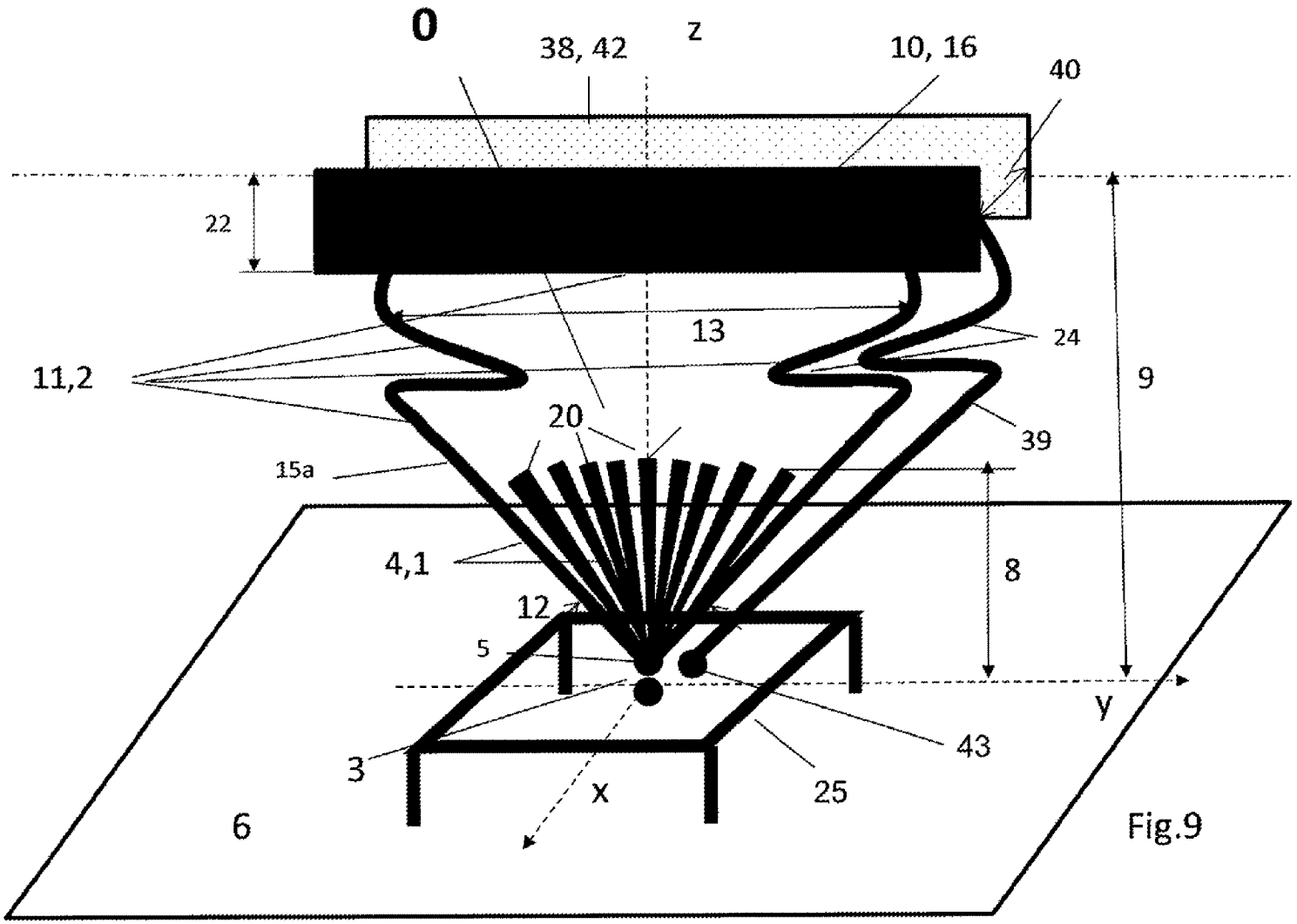
Figure 10:
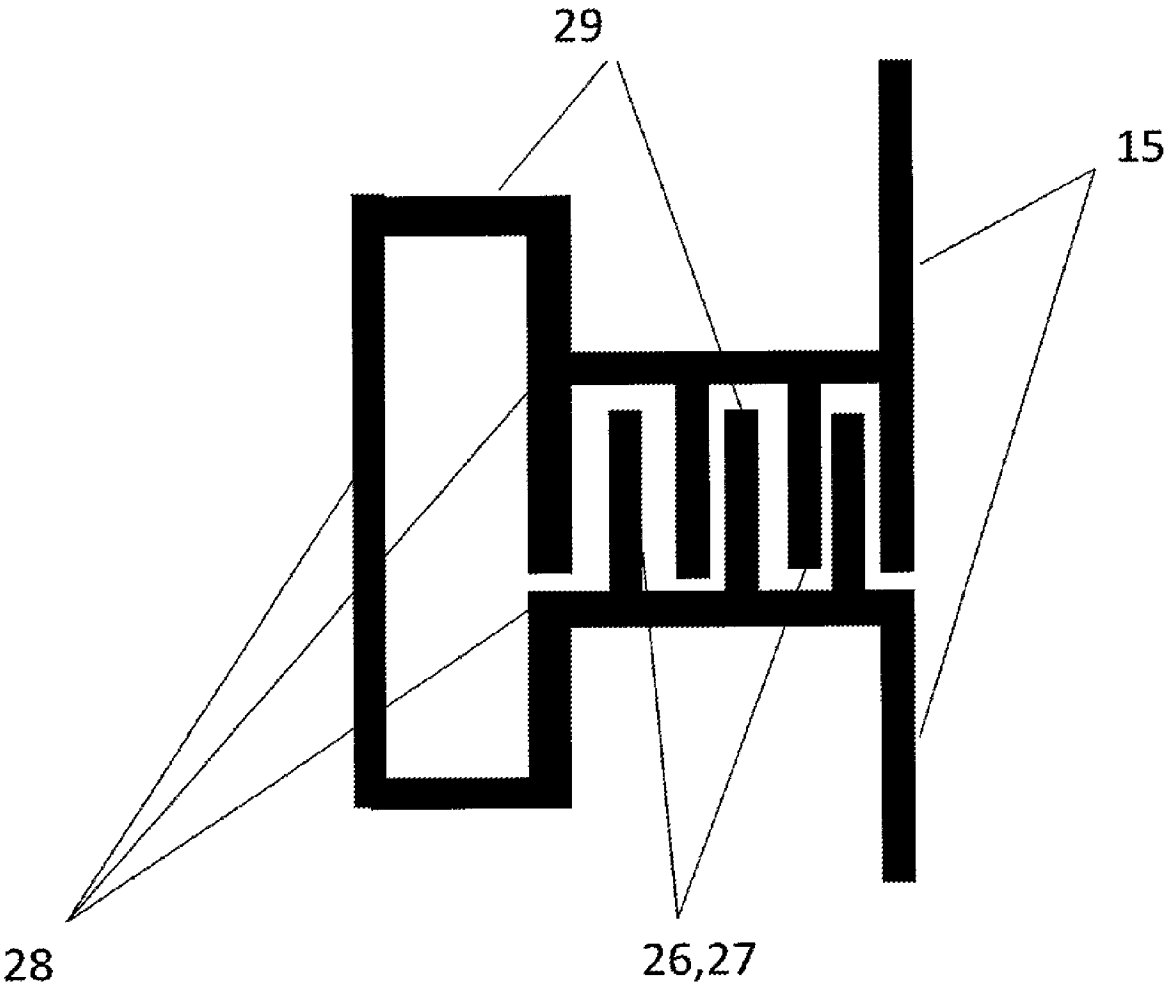
Figure 11:
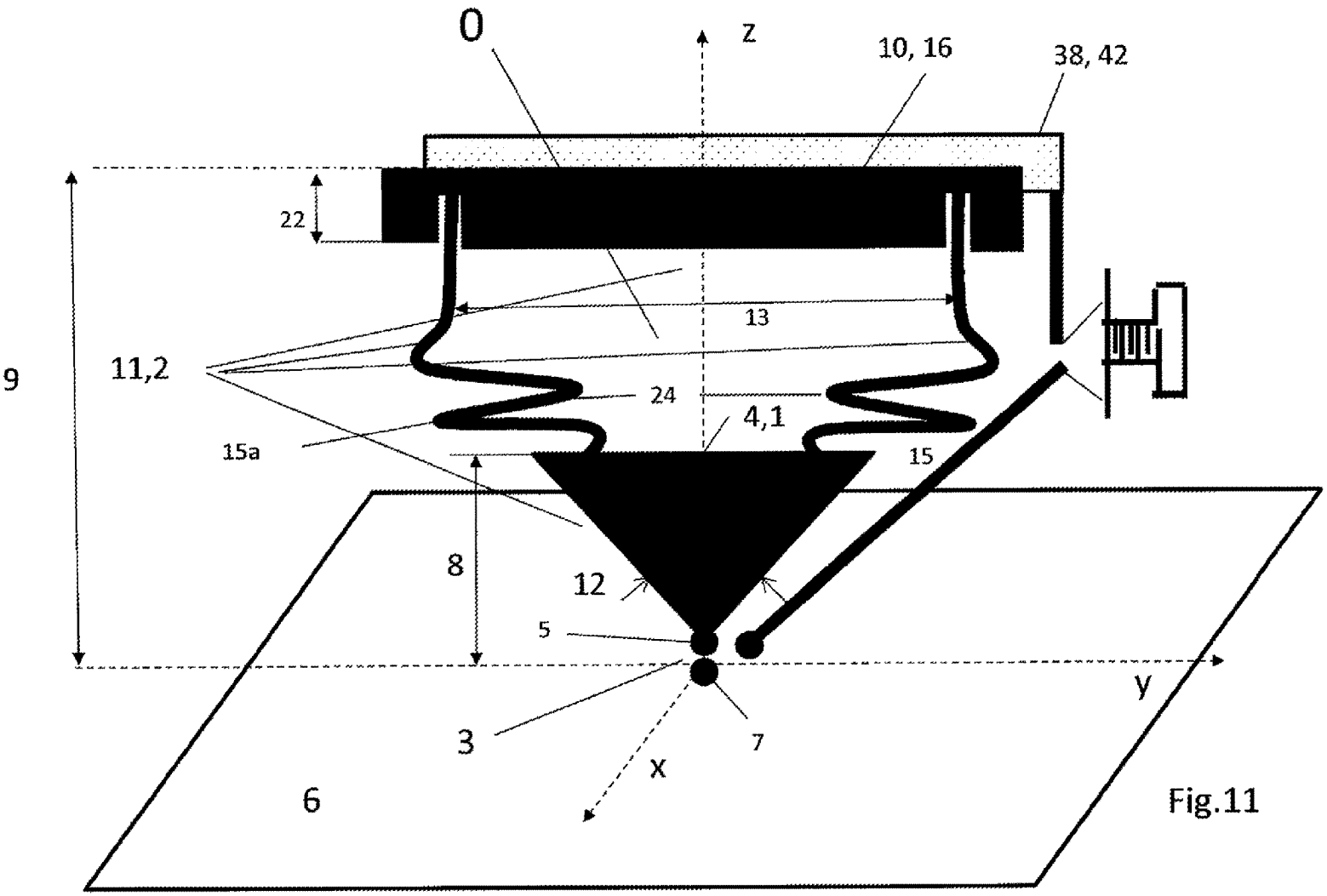
Figure 12:
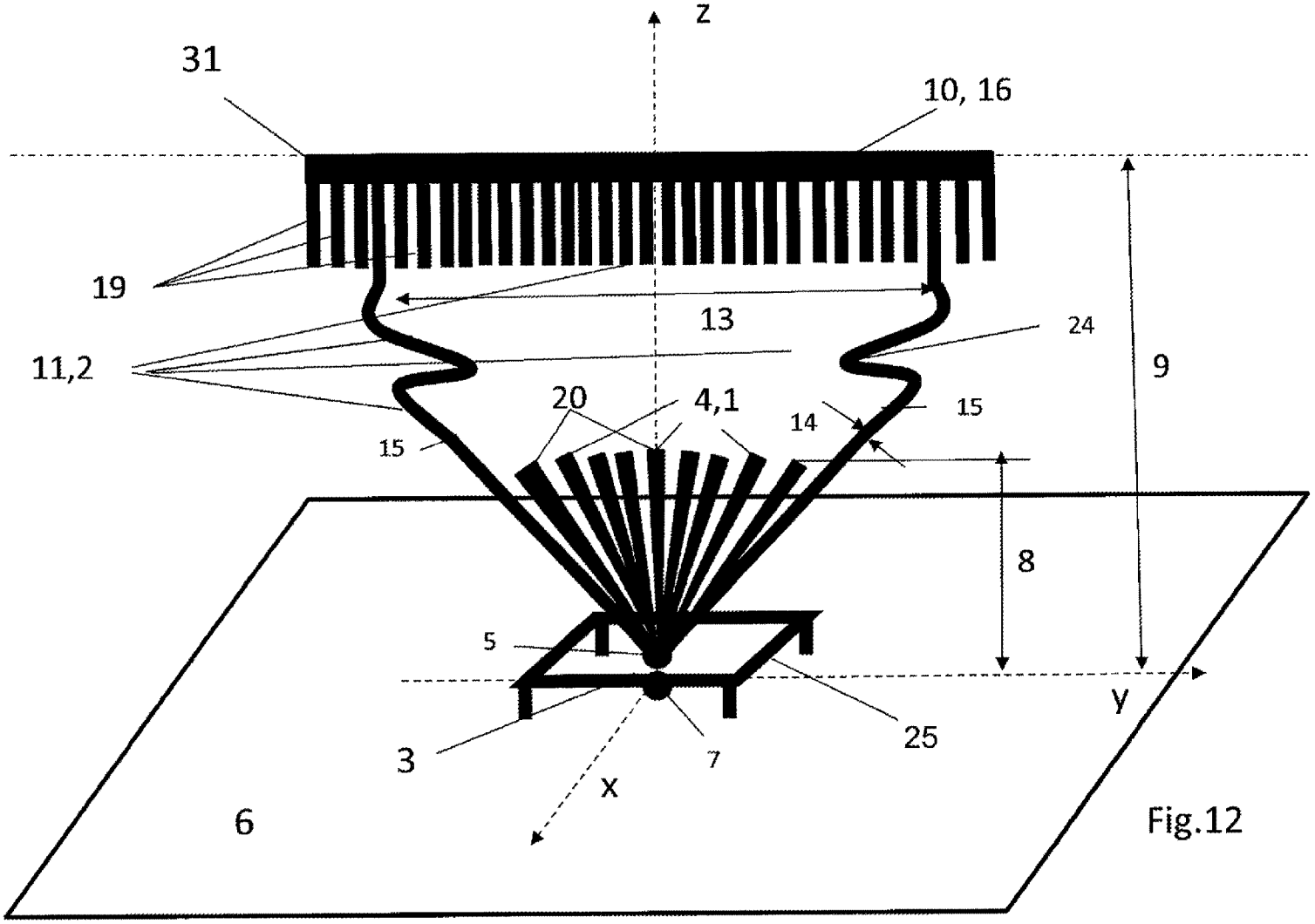
Figure 13:
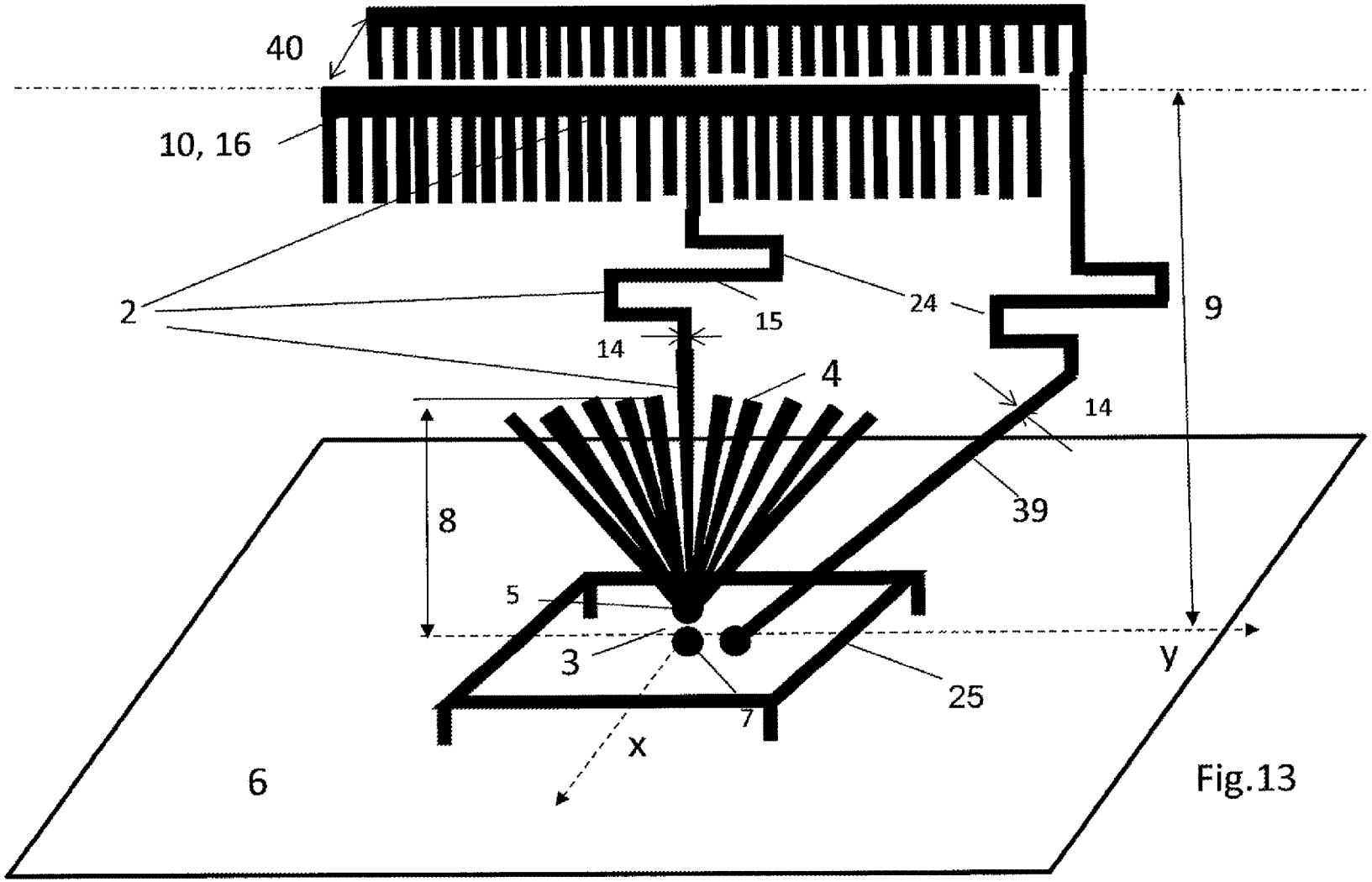
Figure 14:
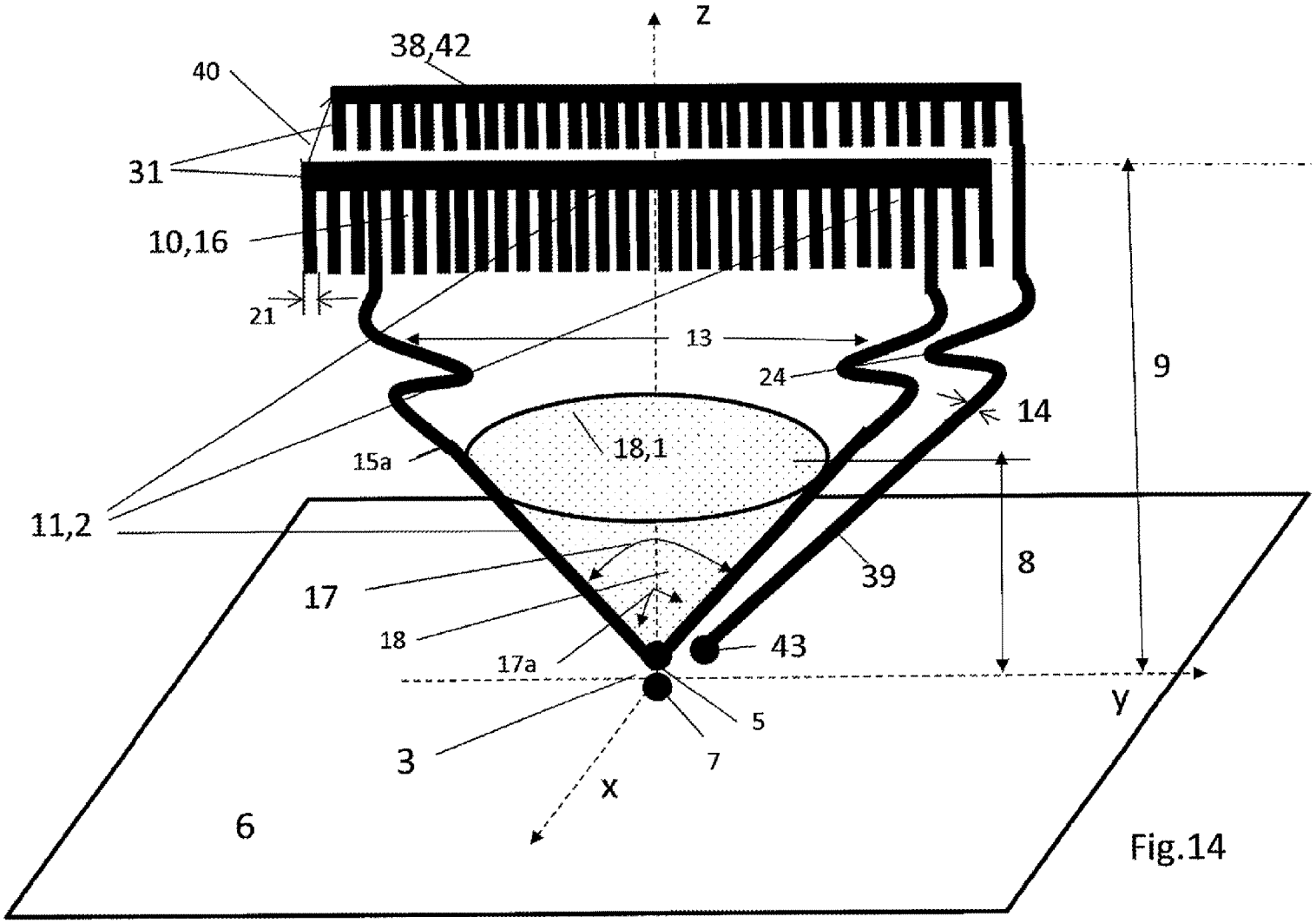
Figure 15:
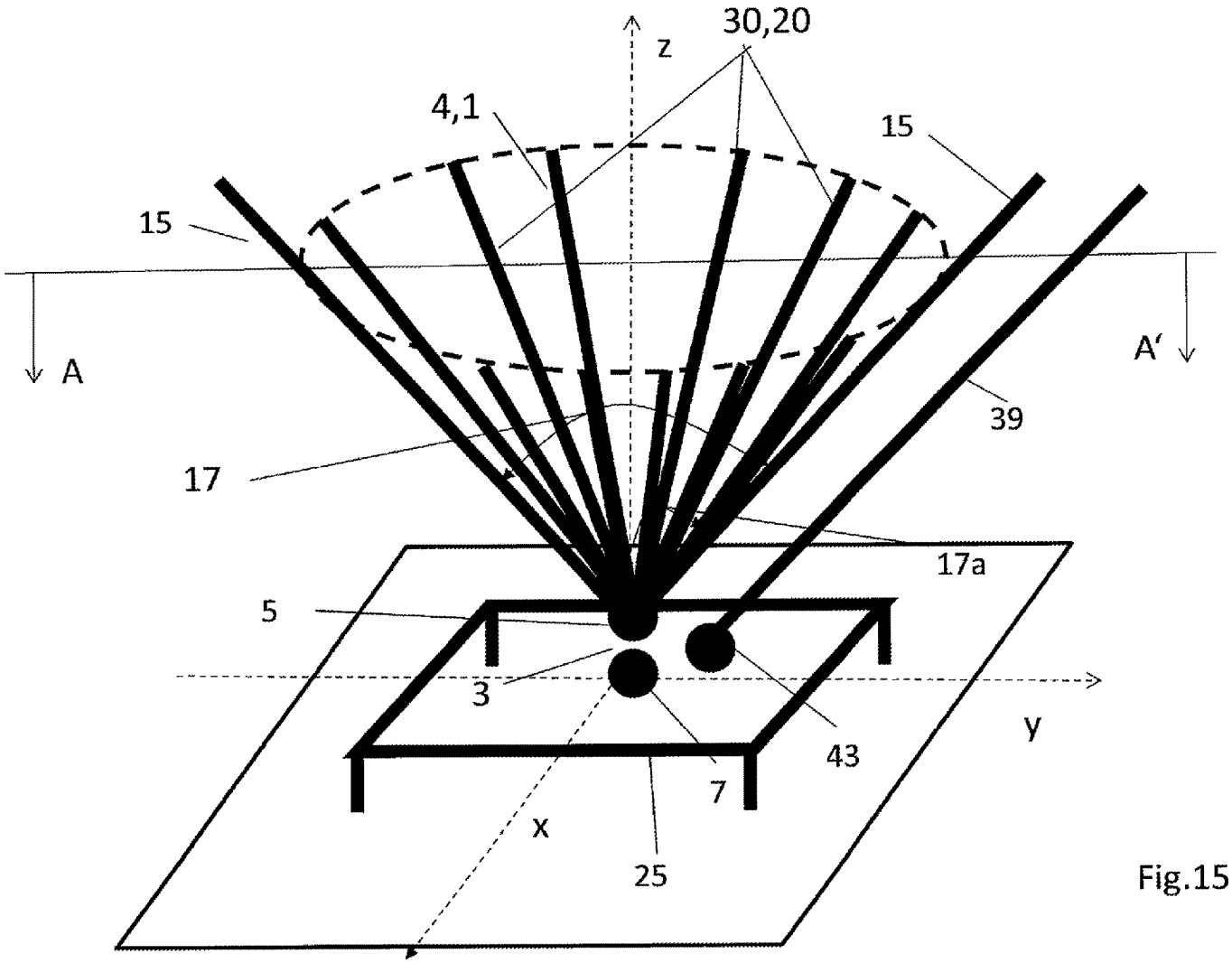
Figure 16:
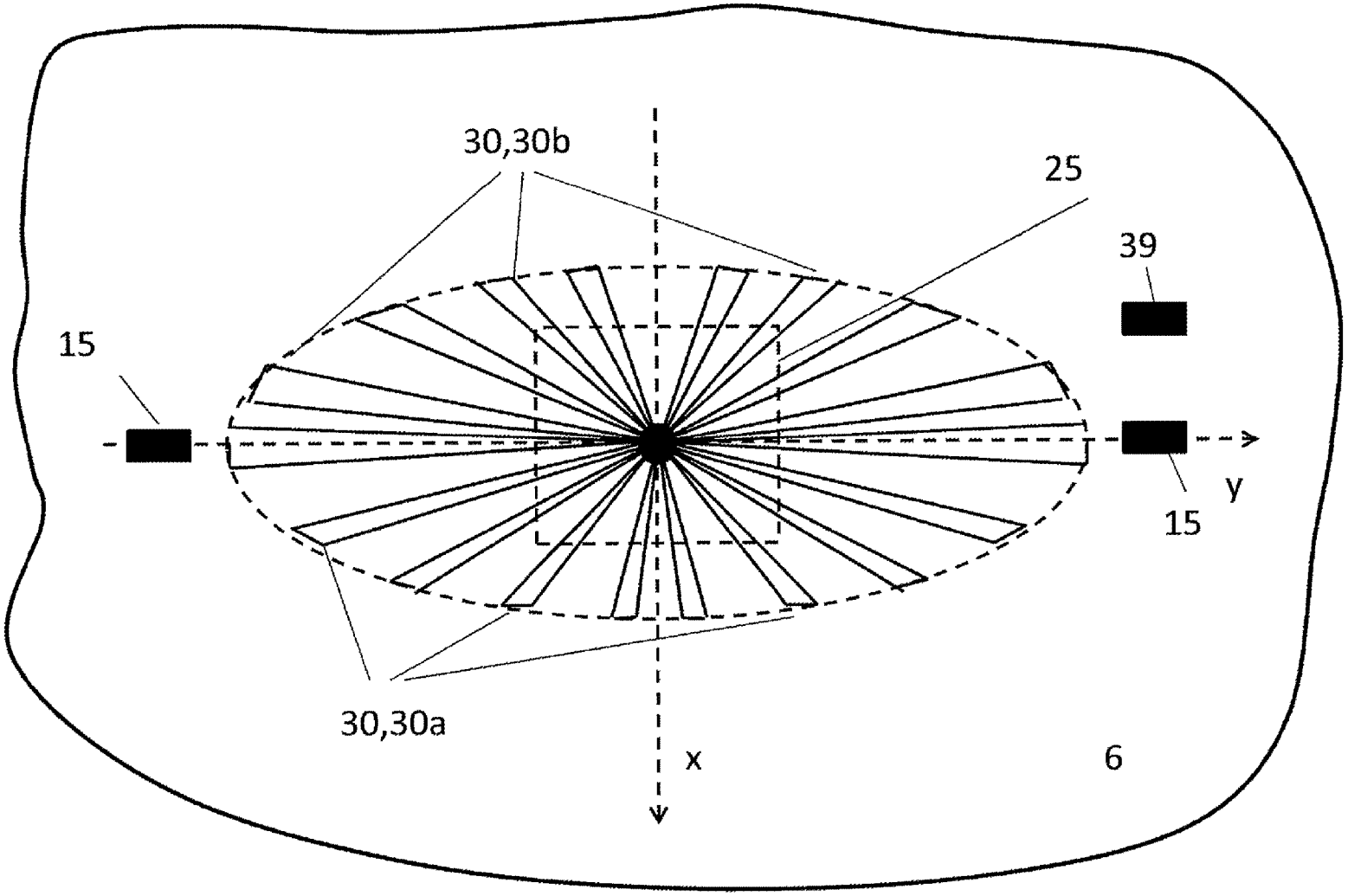
Figure 17:
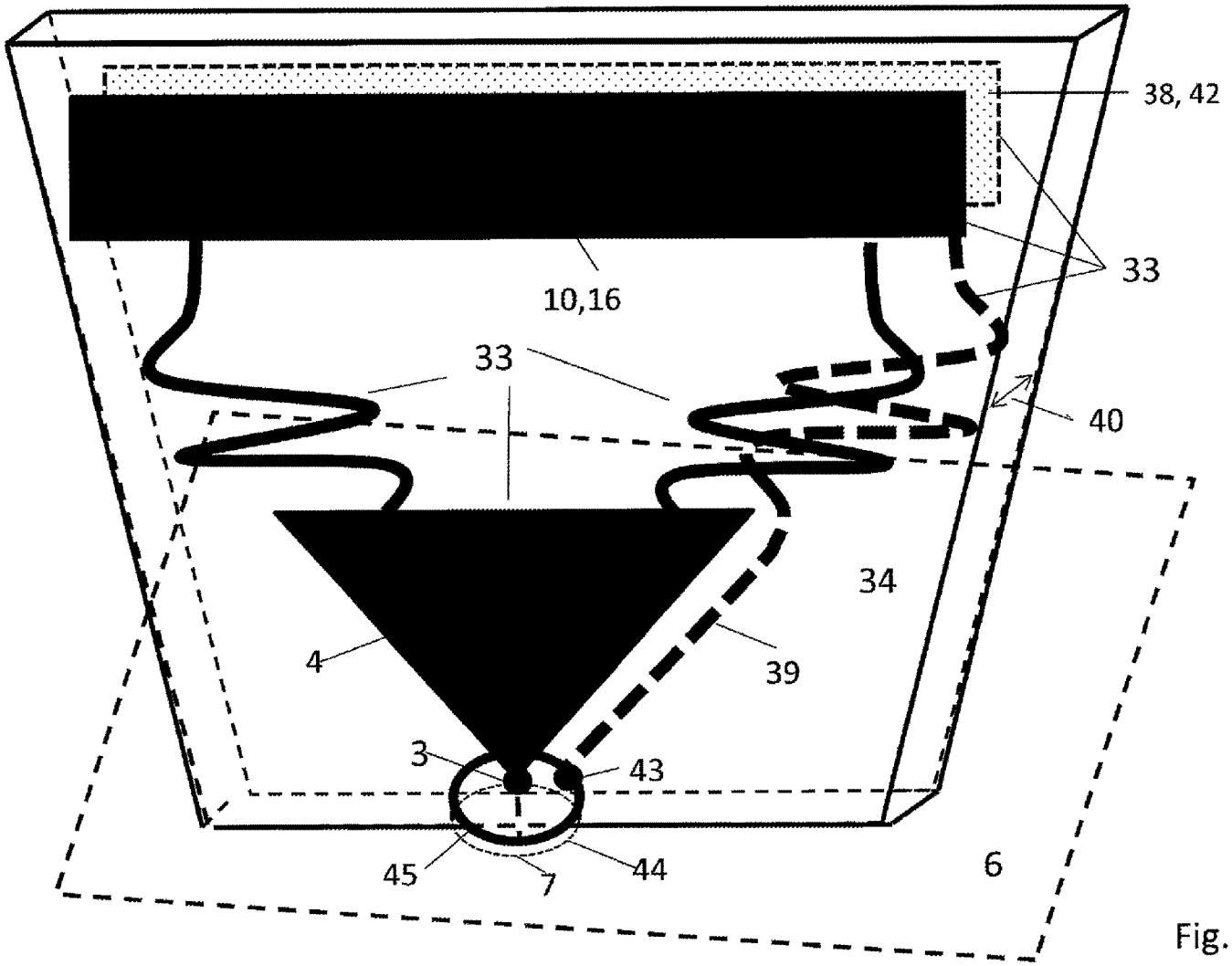
Figure 18:
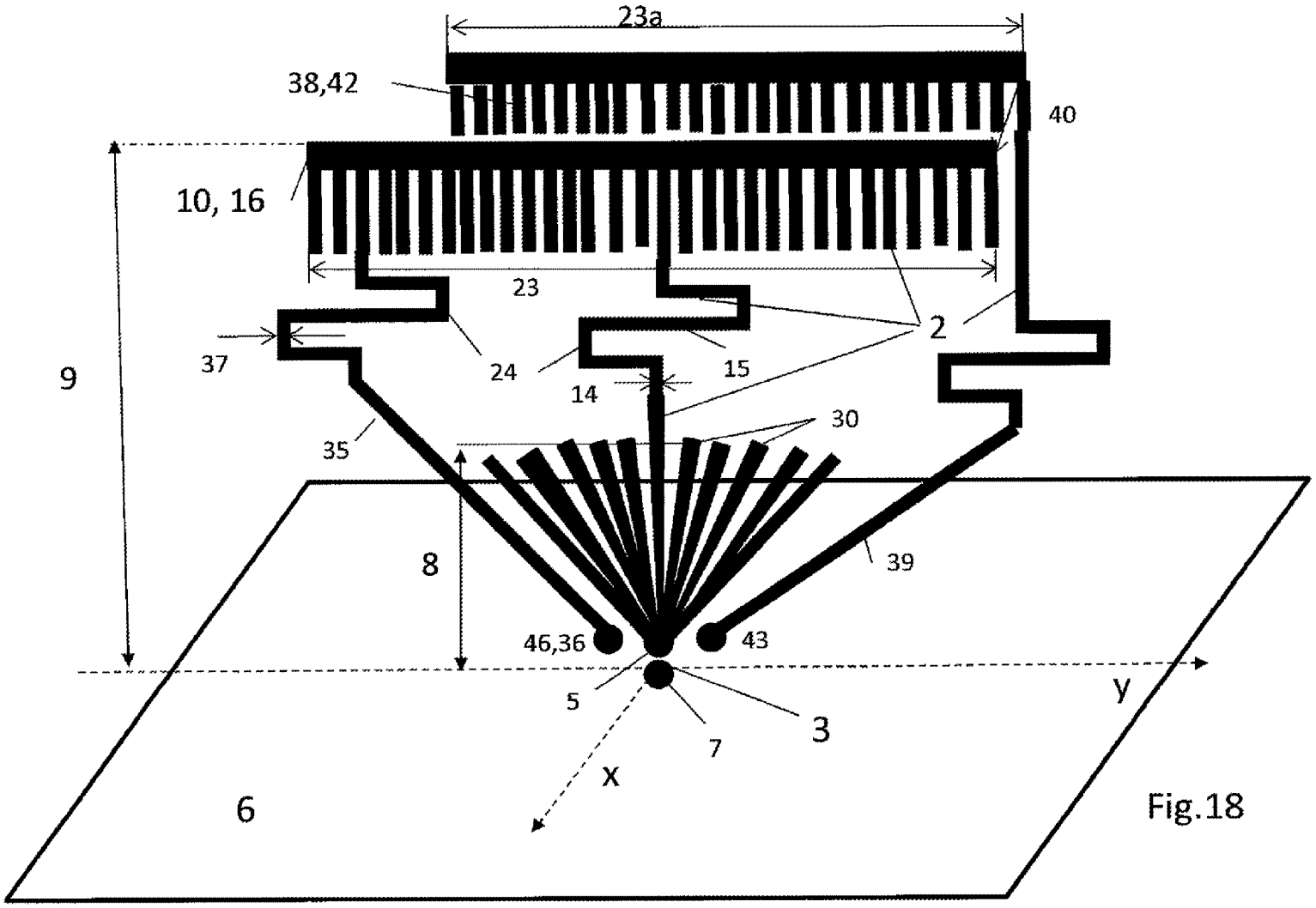
Figure 19:
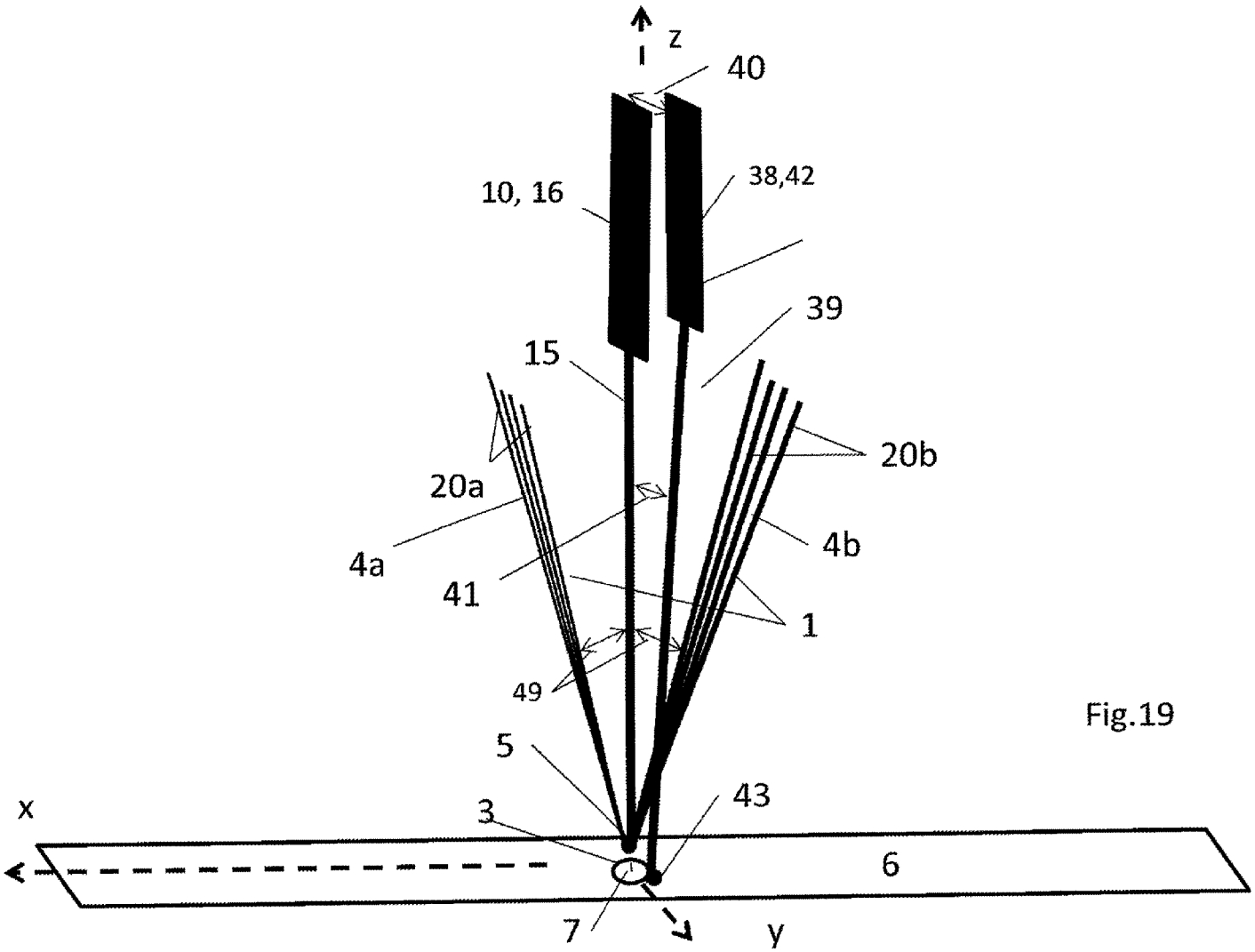
Figure 20:
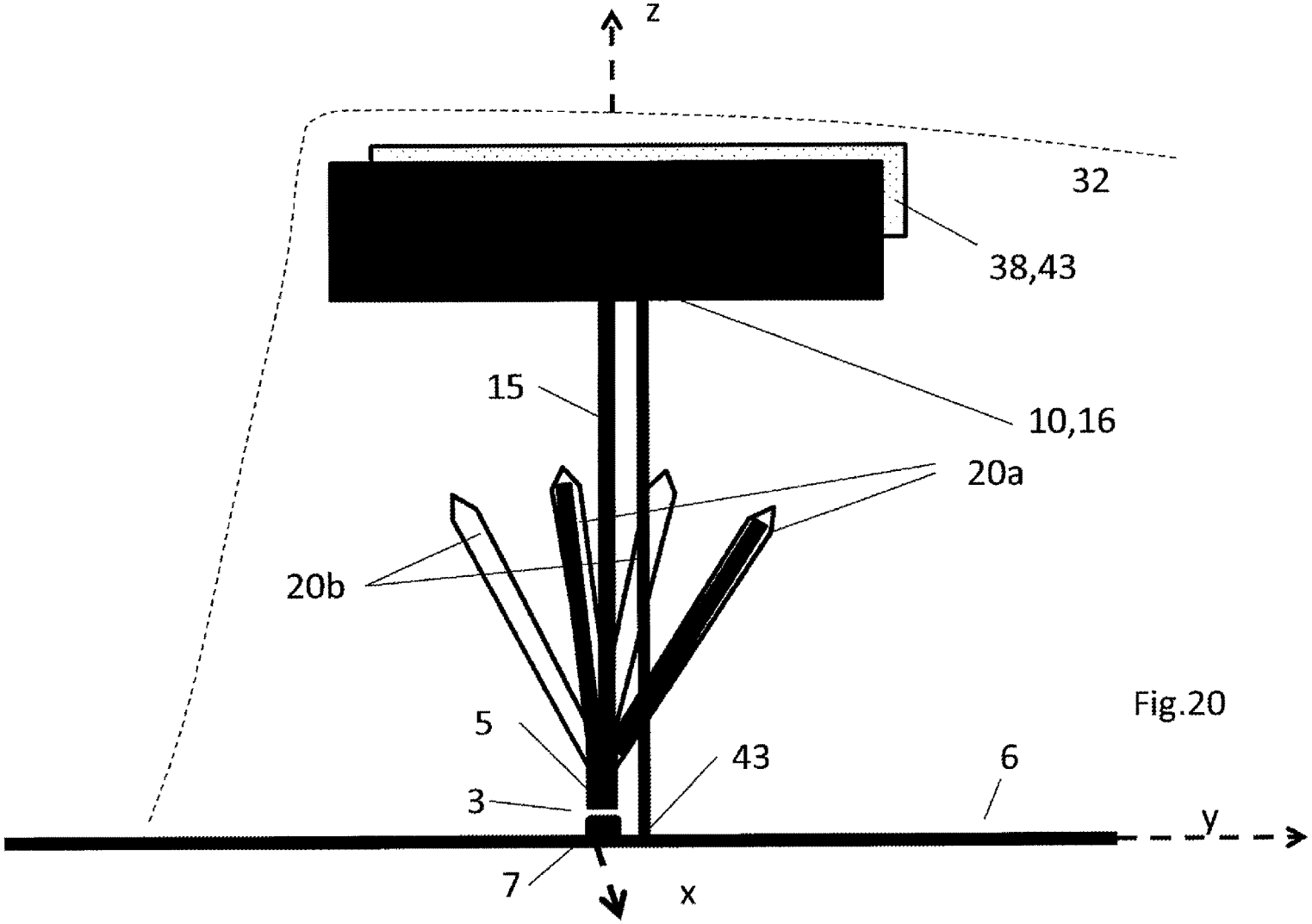
Figure 21:
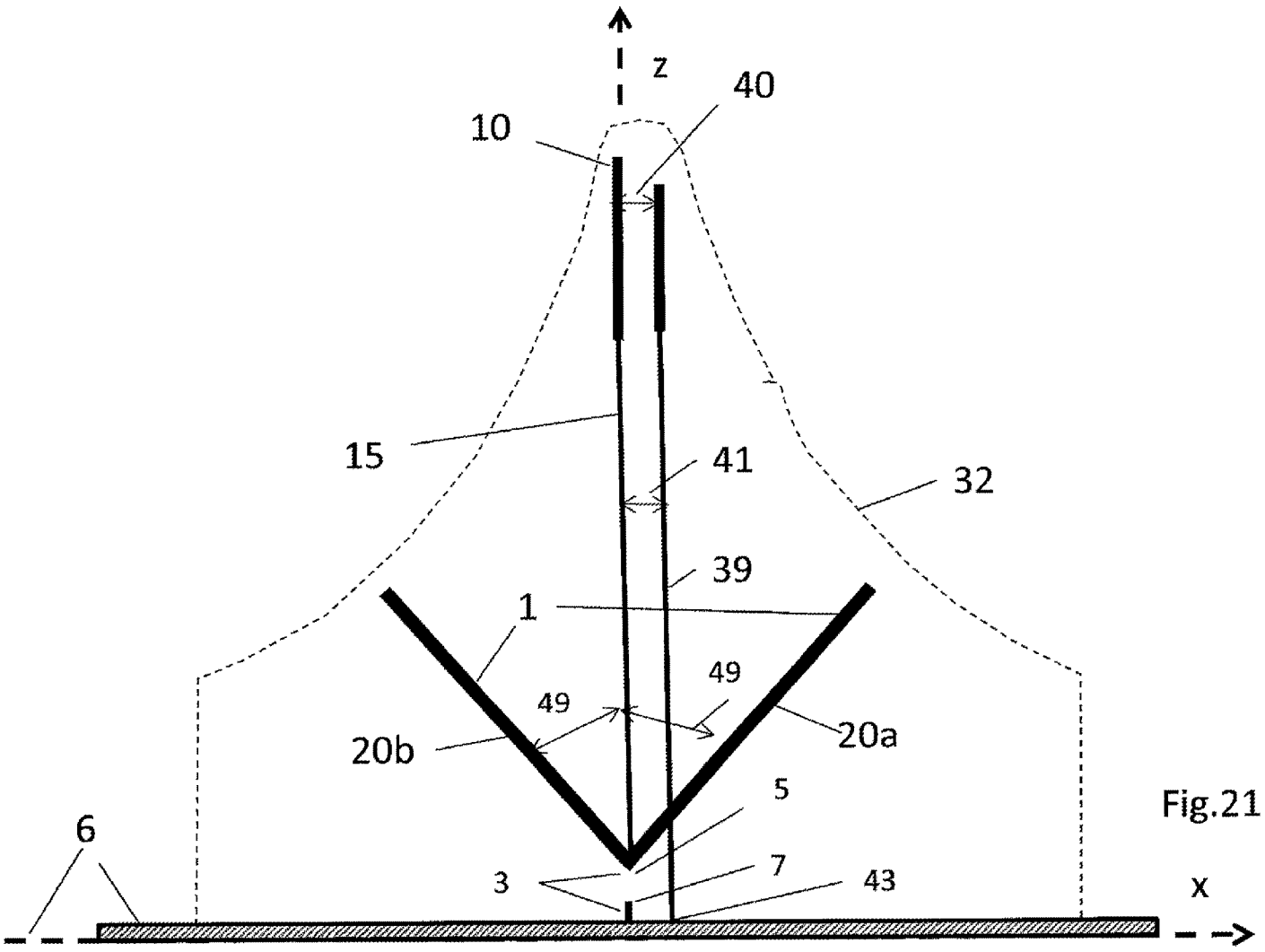
Figure 22:
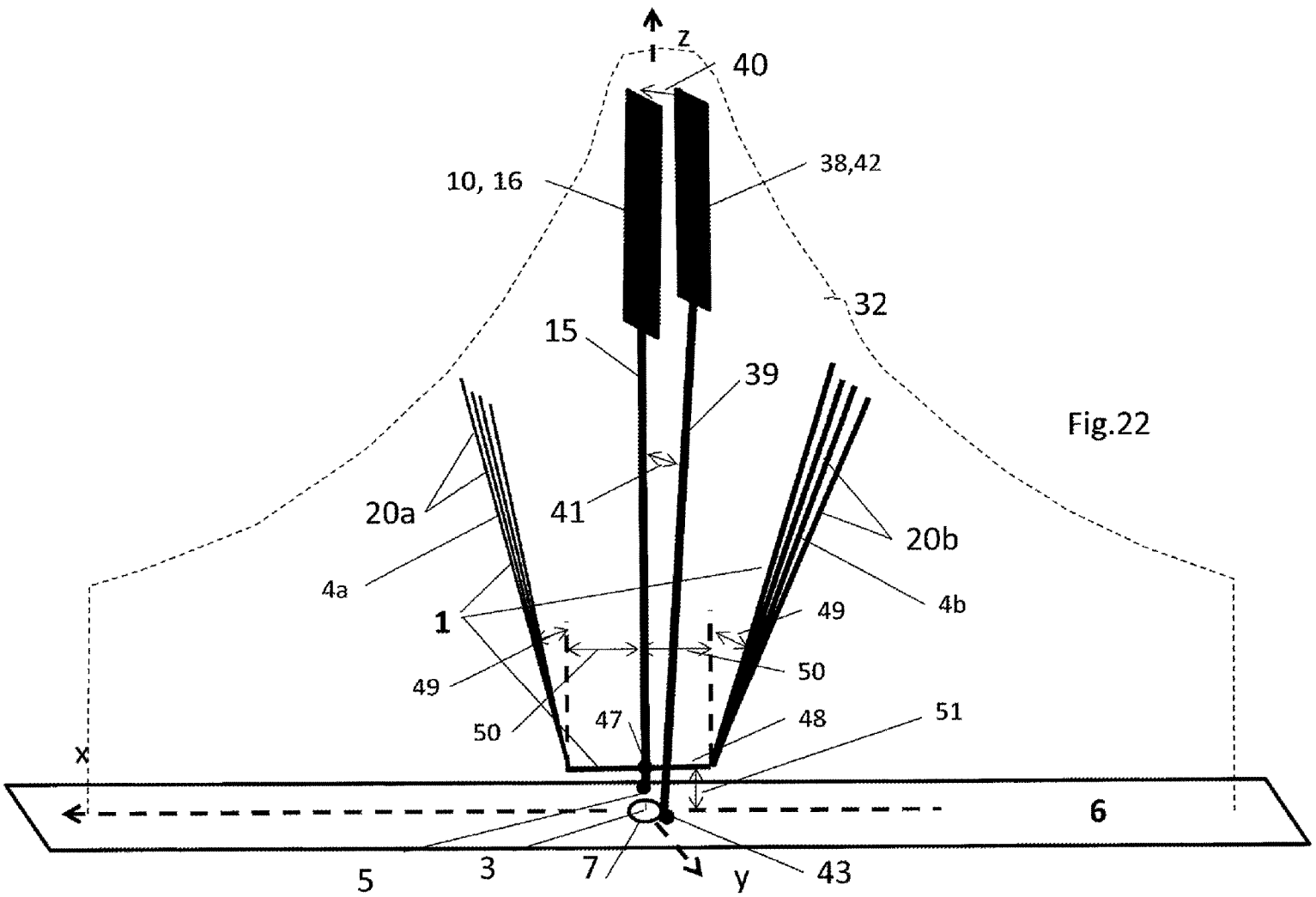

FIG. 7: a) curve of the impedance at the antenna connection site 3 of the singularly standing first structure of 4.5 cm height in FIG. 6 as a partial broadband monopole antenna 0 in accordance with the invention in FIG. 4. Due to the small antenna height 9 of approximately 1/10 at the wavelength at low frequencies of the lower band U, the large incorrect matching of VSWR=12 results with the first structure;

b) impedance curve as in Figure a), but only for the frequency range of the lower band U (700 MHz to 1 GHz) for better clarity;

c) impedance curve as in Figure a), but only for the frequency range of the upper band O (here with 1.35 GHz to 2.7 GHz) for better clarity;

FIG. 8: a multistructure broadband monopole antenna 0 in accordance with the invention with two further conductor strips 39, 39*a* of the further structure of which each is connected—oppositely disposed to one another—to the further roof capacitor 38 in the proximity of a respective one of the side ends and are guided at a spacing from the side margin of the triangular structure 4 to the conductive base surface 6 and are conductively connected thereto at their lower end while avoiding overlap. By avoiding overlap, the coupling of the further conductor strips 39, 39*a* and the upper band monopole 1 is reduced;

FIG. 9: a two-dimensional multistructure broadband monopole antenna 0 in accordance with the invention as in FIGS. 2 and 3, with the areal triangular structure 4 of the upper band monopole 1 being configured by strip-shaped lamellas 20 arranged in the manner of a fan and running together at the lower triangle apex in the triangle plane. The lamellas 20 only conductively connected to one another via the triangle apex effect, on the presence of a concentrically configured ring-shaped satellite reception antenna 25, the electromagnetic decoupling of the upper band monopole 1 from this antenna;

FIG. 10: example of a structure that can be manufactured from conductive foil or sheet metal by stamping or cutting or printed on a circuit board having the frequency behavior of an electrical parallel resonant circuit 29, connected in a first conductor strip 15 or a second conductor strip 39 for configuring the frequency-selective separation of the lower band monopole 2 of the upper band monopole 1. The parallel resonant circuit 29 is formed by the interdigital structure 26 as a parallel capacitance 27 and the conductor loop as a parallel inductance 28;

FIG. 11: a multistructure broadband monopole antenna 0 in accordance with the invention as in FIG. 2, combined with a concentric apex of the areal triangular structure 4. To further increase the inductive effect of the first conductor strips 15, further meandering shapes 24 are formed by way of example;

FIG. 12: only the first structure of the multistructure broadband monopole antenna 0 in accordance with the invention is shown as in FIG. 4 with a ring-shaped satellite reception antenna 25, but with the areal first rectangular structure 16 being formed by strip-shaped roof lamellas 19 extending vertically separately from one another, but contiguous at their upper end via a remaining strip 31 to improve the electromagnetic decoupling between said satellite reception antenna and the lower band monopole 2;

FIG. 13: a multistructure broadband monopole antenna 0 in accordance with the invention as in FIG. 9, that is, however, only provided with one self-supporting first conductor strip 15 with a lager sheet metal thickness in favor of special mechanical stiffness and to achieve the required inherent inductance of the first conductor strip 15 with correspondingly meandering shapes 24;

FIG. 14: a multistructure broadband monopole antenna 0 in accordance with the invention as in FIG. 3, but with an upper band monopole 1 which is conical and which stands on its apex instead of the areal triangular structure in order to improve the bandwidth in the upper band. The electrically conductive cone envelope is indicated by dots;

FIG. 15: an upper band monopole as in FIGS. 9, 12 and 13, but wherein the strip-shaped lamellas 30 of the upper band monopole 1 running together in the manner of a fan in the lower triangle apex are angled out of the plane of the areal triangular structure 4 in a manner such that they extend approximately like the surface lines of a cone standing on its apex in accordance with FIG. 14 and having a circular or elliptical cross-section;

FIG. 16: a plan view of an antenna in accordance with the line A-A' indicated in FIG. 15 for clarifying the extent of the cone lamellas 30, 30*a*, 30*b* extending in the manner of a fan. The ring-shaped satellite reception antenna 25*a* is indicated by interrupted lines;

FIG. 17: a multistructure broadband monopole antenna 0 in accordance with the invention as in FIG. 3, with the first electrically conductive structure, being given by a metallic coating 33 on a first side of a circuit board and the further electrically conductive structure being given on the second side of this circuit board, and the antenna connection site 3 of the multistructure broadband monopole antenna 0 at the lower end of the circuit board preferably being designed as a plug-in connection 45 having a ground connection point 7 and a base surface connection point 43, 44 at the conductive base surface 6;

FIG. 18: An example of a multistructure broadband monopole antenna 0 in accordance with the invention as in FIG. 13, but with a coupling conductor 35 connected to the first roof capacitor 10 and connected to the conductive base surface 6 via the additional ground connector 46 as a supplement to the lower band monopole for the further improvement of the impedance matching to the antenna connector site 3;

FIG. 19: an example of a multistructure broadband monopole antenna 0 in accordance with the invention as in FIG. 13, with the strip-shaped lamellas 20 being angled out of the y-z plane of the areal triangular structure 4 split in the direction of the positive x axis (lamellas 20*a*) and of the negative x axis (lamellas 20*a*) in each case by the deflection angle 49 such that the upper band monopole 1 is substantially formed by two triangular structures 4*a* and 4*b* standing on their apices, whose apices are combined at the antenna connection point 5 and whose surface normals are in substantially the same plane as the surface normal of the first rectangular structure 16. A spatial antenna structure is thereby formed. The first conductor strip 15 and the further conductor strip 39 are shown in simplified form as straight conductors guided with respect to one another at the conductor strip coupling spacing 41 and can contain shapes meandering in their realization, as in FIGS. 13 and 18. The surface normals of the rectangular structures of the first roof capacitor 10 and those of the further roof capacitor 38 preferably face in the x direction;

FIG. 20: the installation situation of a multistructure broadband monopole antenna 0 in accordance with the invention in accordance with FIG. 19 on the outer skin of a vehicle under a covering hood 32 in a weakly perspective representation with a view of the antenna approximately from the x direction, that is transversely to the direction of travel (y direction). The conductor parts shaded in black and marked by a)—that is the lamellas 20*a*—are angled out of the y-z plane of the areal triangular structure 4 in the direction of the x axis and are angled out in the direction of the negative x axis in accordance with the lamellas 20*b*, whereby the spatial antenna structure is formed;

FIG. 21: the installation situation of a multistructure broadband monopole antenna 0 in accordance with the invention in a similar manner as in FIG. 20, but with a view of the arrangement in the direction of travel (y direction);

FIG. 22: a multistructure broadband monopole antenna 0 in accordance with the invention with an upper band monopole 1, comprising two triangles 4*a* and 4*b* standing on their apices and angled out in the positive or negative x direction in each case by the deflection angle 49 with respect to the direction of the z axis, as in FIG. 19, but with triangle apices that are symmetrically offset to the first conductor strip 15 in the x direction by the offset length 50 and that are connected via a short connection conductor 48 guided over the small base surface spacing 51 in parallel with the x axis and to the first line strip 15 in the branch point 47 from where the antenna connector point 5 is formed; and FIG. 23: a further advantageous embodiment of the further areal structure of the further roof capacitor by an electrically conductive conductor strip that extends in a surface in parallel with the first rectangular structure at the roof capacitor coupling spacing and that is meandering in shape.

A special advantage of a multistructure broadband monopole antenna 0 in accordance with the invention is the property that the impedance which can be measured at the antenna connection site 3 can be configured largely problem free in a broadband manner in the proximity of the standardized impedance of Z0=50 ohms prescribed for antenna systems for vehicles. The economic advantage further results from this that a matching network between the antenna connection site 3 at the nadir of the multistructure broadband monopole antenna and the continuative circuit can mostly be dispensed with or can at least be configured as particularly low effort.

A multistructure broadband monopole antenna 0 in accordance with the invention will be explained by way of example in the following for the two frequency ranges separated by a frequency gap in accordance with the lower band U and the upper band O shown in FIG. 1.

The first structure of the multistructure broadband monopole antenna in its areally configured basic design is shown in FIG. 2 and is substantially formed from a portion of the lower band monopole 2 for covering the lower band with an antenna height 9 required for this purpose in combination with an upper band monopole 1 with the upper band monopole height 8 with a common antenna connection site 3. To avoid too great an effective antenna height 9 in the frequency range of the upper band, the lower band monopole 2 is configured from first conductor strips 15 of inductively high impedance in the frequency range of the upper band O and having a narrow strip conductor width 14 in connection with a first roof capacitor 10. The latter is substantially configured as an areal first rectangular structure 16 and with a large horizontal extent 23 in comparison with the vertical extent 22.

FIG. 3 shows the three-dimensional multistructure broadband monopole antenna 0 in accordance with the invention in a weakly perspective representation. It comprises the first electrically conductive structure as in FIG. 2, combined with the further electrically conductive structure. The latter substantially comprises the further roof capacitor 38 in the form of the further rectangular structure 42 (drawn dotted for clarification) that is guided at a roof capacitor coupling spacing 40 substantially in parallel with the first rectangular structure 16 of the first structure and with a further conductor strip 39 connected to the further rectangular structure 42 and extending toward the conductive base surface 6. The further conductor strip 39 is guided at a guide strip coupling spacing 41 substantially in parallel with the first conductor strip 15 toward the conductive base surface and is conductively connected thereto at the base surface connection point 43. To increase the inherent inductance of the first conductor strips 15, 15*a* and of the further conductors strip(s) 24, meandering shapes 24 are present. The lower band monopole 2 is completely formed by the combination of the first conductive structure and of the further conductive structure. Reference symbol Z characterizes, as also in the other Figures, a (vertical) center axis that extends through the antenna connection point 5 and that in particular forms a symmetry axis of the antenna.

FIG. 4 shows a further advantageous embodiment of a multistructure broadband monopole antenna 0 in accordance with the invention with a first electrically conductive structure as in FIG. 3, wherein the vertically extending outer sides to the left and right of the triangular structure 4 are fanned out from the contiguous electrically conductive central part above the apex of the triangle and are designed as conductor strips and wherein they are formed as conductor strips 15 above the triangular structure 4 and are connected to the first rectangular structure 16, whereby a frame structure 11 is likewise formed. The further rectangular structure 42 of the further electrically conductive structure is, as in FIG. 3, arranged at the roof capacitor coupling spacing 40 in parallel with the first rectangular structure 16 and the further conductor strip 39 is guided at the conductor strip coupling spacing 41 substantially in parallel with the first conductor strip 41. The representation shows that the roof capacitor coupling spacing 40 and the conductor strip coupling spacing 41 can be selected as different in an advantageous manner. By setting the roof capacitor coupling spacing 40 and the conductor strip coupling spacing 41 and by selecting the horizontal extent 23*a* and the vertical extent 22*a* of the further roof capacitor 38, an impedance matching is achieved at the antenna connection 5 or at the coaxial plug-in connection located there without any additional electrical components, in particular also at the lower end of the lower frequency band U.

To satisfy the demand for a manner of manufacturing that is as simple and as economic as possible, both the first structure and the further structure of the multistructure broadband antenna 0 in accordance with the invention are, for example, each configured from an electrically conductive foil 33 as a contiguous electrically conductive structure extending in a plane extended substantially perpendicular to the conductive base surface 6. It is in this respect shown as a particularly advantageous embodiment of the invention for the self-supporting electrically conductive structures that are in particular each formed in one piece to use electrically conductive sheet metal or a respective self-supporting electrically conductive foil from which a mechanically self-supporting arrangement of the structures can be manufactured for the total multistructure broadband monopole antenna 0. These structures can by way of example be manufactured by a stamping process or by a controlled cutting process, for example by controlled laser cutting. In this respect, the manufacture of a stamping tool will prove to be economically advantageous with particularly large volumes because the antenna can be reproduced extremely inexpensively by automated stamping processes. On the other hand, with smaller volumes, laser cutting controlled by computer can prove to be more economic. The manufacture of the multistructure broadband monopole antenna 0 from sheet metal provides the particular advantage of metallic stiffness which is of particular importance for the use as a vehicle antenna. The negligible wind resistance can be named as a special advantage of this areally configured structure when it is configured in an advantageous manner as extending in a plane whose normal is oriented perpendicular to the direction of travel of the vehicle.

Corresponding to the additional objective with respect to the required mechanical stability for holding the first roof capacitor 10 by narrow first conductor strips 15, 15*a* provision is made in accordance with the invention to design the latter as mechanically sufficiently stiff. In a particularly advantageous embodiment of a multistructure broadband monopole antenna 0 in accordance with the invention designed from stamped or cut sheet metal, a frame structure 11 is configured to achieve a special stiffness. In this respect, the frame structure 11 is shown for the first structure in FIGS. 2, 3, 4. The frame structure 11 is in each case formed from two narrow first conductor strips 15, 15*a* guided at a sufficient spacing 13 from one another, from the base line of the areal triangular structure 4 and from the areal first rectangular structure 16 of the first roof capacitor 10.

In a further advantageous embodiment of the invention, the example of a multistructure broadband monopole antenna 0 is shown in FIG. 8 having two further conductor strips 39, 39*a*. Both further conductor strips 39, 39*a*, of which each is connected—disposed opposite one another—in the proximity of a respective one of the side ends to the further roof capacitor 38 and is guided at a spacing from the side margin of the triangular structure 4 while avoiding the overlap of the triangular structure 4 are connected at the lower end to the conductive base surface 6. A frame structure, comprising the further conductor strips 39, 39*a* and the further rectangular structure 42, is thus likewise formed such that the further structure can also be implemented with an advantageous stiffness.

In a further advantageous embodiment of the invention, the first electrically conductive structure comprises a material of particular stiffness, for example sheet metal. On a use of such materials, the multistructure broadband monopole antenna 0 can be configured with only one first conductor strip 15, as shown in FIG. 13. In the interest of mechanical stability, however, a larger strip conductor width 14 is then advantageous this. As a rule a plurality of meandering shapes 24 have proven to be necessary to configure a sufficiently large inductive effect of the first conductor strip 15. These demands equally apply in FIG. 13 to the further conductor strip 39 that connects the further rectangular structure 42 to the conductive base surface 6. To avoid problems with stiffness, the antenna in FIG. 13 can advantageously be implemented as a printed circuit board similar as to shown in FIG. 17.

With a multistructure broadband monopole antenna 0 of this type, the voltage standing wave ratio (VSWR)<3 is required in the above-named lower band, for example, for the matching of antenna systems to the standardized impedance of Z0=50 ohms prescribed for vehicles. This value can generally already be achieved with an antenna height 9 of <6 cm with an antenna in accordance with the invention in its complete design at the antenna connection site 3. The properties of the lower band monopole 2 are substantially determined by its antenna height 9 and by the size of the areal first roof capacitor 10 whose horizontal extent 23 is substantially larger at approximately 5 cm, that is it may be configured approximately at least three times as large as the vertical extent. A substantially larger vertical extent 22 admittedly increases the capacitance value of the first roof capacitor 10 with a predefined antenna height 9, but reduces the effective height of the lower band monopole 2 which, in contrast to the capacitance value, enters into the formation of the frequency bandwidth of the lower band monopole 2 in squared form. The combination of the first structure with the further structure in accordance with the invention is in particular necessary to satisfy the matching demand with VSWR <3 at the lowest frequencies of the lower band U. This can be seen particularly impressively from a comparison of the impedance values at the antenna connection site 3 of the multistructure broadband monopole antenna 0 in FIG. 4 and from the singularly standing first structure in FIG. 6. The corresponding frequency curves of the impedance values are shown for the frequency range of the lower band U in FIGS. 5*b* and 7*b*. At the lowest frequency of 700 MHz, the real portion of the impedance (related value=0.18) of the singularly standing first structure is extremely low at a high negative imaginary portion such that the completely unacceptable VSWR value of 12 results for this. In contrast to this, the real portion of the impedance in FIG. 5*b* with the high relative value of approximately 3 is given with a small imaginary portion. The VSWR value amounts to approximately 3.5 in this example. The impedance curve in FIG. 5*b* furthermore shows the tendency of the enlacement of the matching point, by which the substantially larger bandwidth in the lower band U is caused. It is thus shown that the desired improvement of the impedance at the antenna connection site 3 of the first structure is given with respect to the impedance matching and its bandwidth with the aid of the capacitive coupling of the roof capacitors in accordance with the invention in conjunction with the coupling of the conductor strips between the first structure and the further structure. With respect to the configuration of a bandwidth which is as large as possible in this frequency range, the antenna height 9 and the size of the first rectangular structure 16 with its horizontal extent 23 and its vertical extent 22 are of decisive importance. It is important in this respect to select the vertical extent 22 ideally with a given antenna height 9. It also follows on from this that the extents of the further rectangular structure 42 are as a rule to be selected as smaller than the extents of the first rectangular structure 16 to achieve ideal impedance matching at the antenna connection site 3 in this frequency range. The roof capacitor coupling spacing 40 can in this respect be very small and should not exceed a value of $\lambda/30$ at the lowest frequency of the lower band U. The lower band monopole 2 of the multistructure broadband monopole antenna 0 is thus formed by the described combination in accordance with the invention of the first structure with the further structure with its antenna connection site 3 at the first structure. It is only possible in this manner to satisfy the high matching demands in the entire lower band U without using concentrated components in a matching network.

Figure 7C:
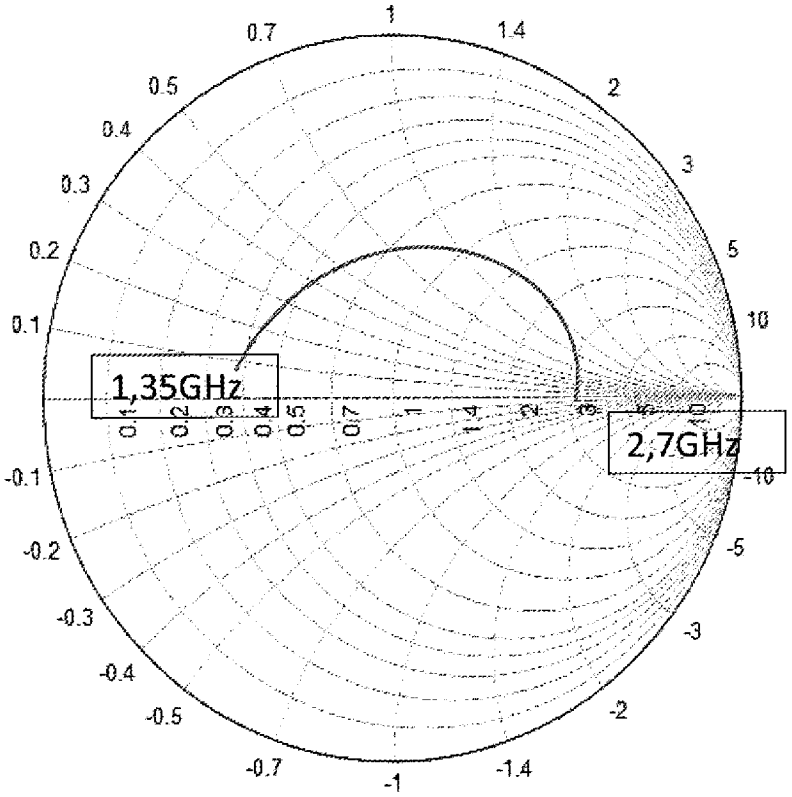
Figure 7B:
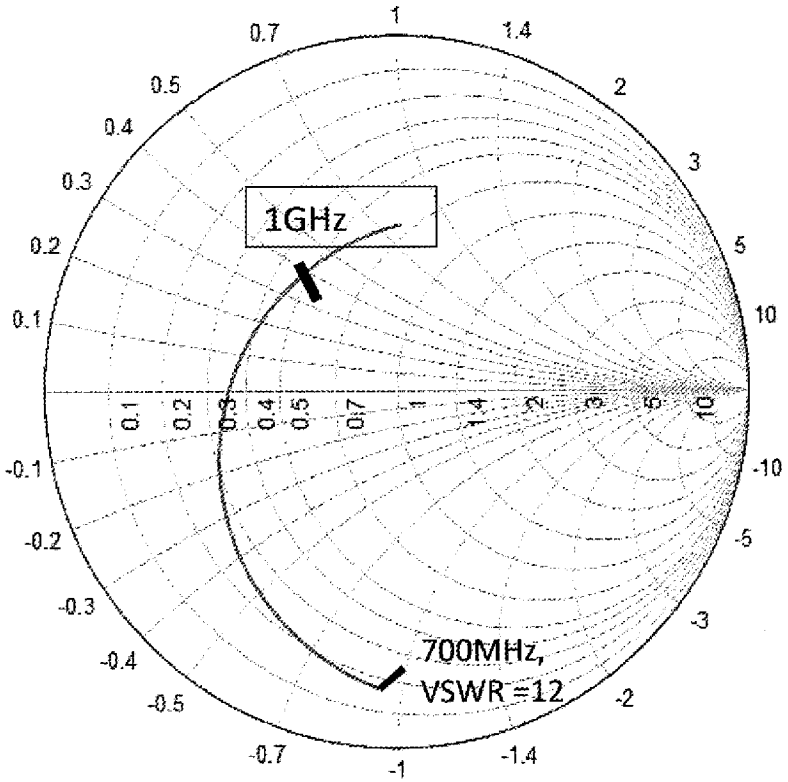

It can equally be seen from this comparison between the antenna in accordance with the invention in FIG. 4 and the singularly standing first structure in FIG. 6 that the tendency of the larger bandwidth in the case of the multistructure broadband monopole antenna 0 is also confirmed in the upper band 0 since the impedance curve in FIG. 5*c* of the antenna in FIG. 4 enlaces the matching point at the antenna connection site 3 with a larger bandwidth than the impedance curve in FIG. 7*c* of the singularly standing first structure in FIG. 6.

Particularly good matching values were achieved by way of example by the combination in accordance with the invention of the first and further structures using a multistructure broadband monopole antenna 0 in accordance with the invention in the frequency range of the lower band U. As shown in FIG. 5*d*, the frequently demanded condition of VSWR <3 was satisfied in the total lower band U with an antenna height 9 of only 52 mm (this is a relative antenna height of 12% at 700 MHz) and with a horizontal extent 23 of the first roof capacitor 10 of only 30 mm. The impedance curve in FIG. 5*e* corresponding to this VSWR curve is within the shown circle for VSWR=3 in the total frequency range between 700 MHz and 960 MHz.

The electrically conductive structures can also be selected in an advantageous embodiment of the invention by the metallic coating of a dielectric board, that is of a circuit board. It must, however, be taken into account in this respect that a material for the circuit board which can be considered for economic reasons is subject to losses in the decimeter wave spectrum so that provision can be made in accordance with the invention to print the structure of the multistructure broadband monopole antenna 0 onto the circuit board in a manner known per se, but to cut it approximately in accordance with the outlines of the multistructure broadband monopole antenna 0 with a slight overhang in order to keep the extent of electrical field lines in the dielectric board suffering from loss as small as possible. This type of printed representation of conductive structures is in particular advantageous with a complicated geometrical structure of the multistructure broadband monopole antenna 0 because the lines can be configured less fine following the geometrical structure and therefore require a less complex and/or expensive stamping tool. The property of the above-described small roof capacitor coupling spacing 40 of an antenna in accordance with the invention allows the advantageous implementation of a multistructure broadband monopole antenna 0 in accordance with the invention, as shown in FIG. 17, on a circuit board, wherein the first electrically conductive structure is given by a metallic coating 33 on a first side of a circuit board and the further electrically conductive structure is given on the second side of this circuit board and the antenna connection site 3 of the multistructure broadband monopole antenna 0 at the lower end of the circuit board is preferably designed as a coaxial plug-in connection 44 having a ground connection point 7 as a coaxial plug outer conductor 45 with a connection to the conductive base surface 6 and having a base surface connector point 43 at the conductive base surface 6. The property of the small roof capacitor coupling spacing 40 of an antenna in accordance with the invention furthermore allows the advantageous implementation of the first and further structures together on one and the same side of a circuit board. Both structures can, for example, also be implemented on only one side of a circuit board by configuring interdigital structures for the implementation of the first roof capacitor 10 and of the further roof capacitor 38 that engage into one another like a comb in order thus to establish the required capacitive coupling between the two roof capacitors.

The formation of the upper band monopole 1 is substantially given by the areal triangular structure 4 of the first structure provided that the inductive effect of the first conductor strips 15 having a narrow strip conductor width 14 is sufficiently large for the separation of radio signals in the upper band O from the first roof capacitor 10. This is given as a rule with a strip conductor width of smaller than or equal to 7 mm. Provision can be made in accordance with the invention to provide the first conductor strips 15 with meandering shapes 24 to increase this separating effect. The functional division of the multistructure broadband monopole antenna 0 into the lower band monopole 2 and the upper band monopole 1 is naturally not be seen strictly. The transition between the effects is rather blurred and the division is to be understood as a description for the primary effects in the two frequency ranges. The mode of operation of the upper band monopole 1 located above the conductive base surface 6 is substantially given by the configuration of the areal triangular structure 4. In the interest of a particularly broadband behavior, in this embodiment an areal triangular structure 4 is provided standing on its apex and having a triangle opening angle 12 whose apex is connected to the antenna connection point 5. The antenna connection site 3 for the multistructure broadband monopole antenna 0 is formed by said antenna connection point together with the ground connection point 7 on the conductive base surface 6. The height of the baseline of the areal triangular structure 4 over the conductive base surface 6 substantially forms the effective upper band monopole height 8 by which the frequency behavior of the upper band monopole 1 is substantially determined. For reasons of the vertical radiation diagram for the communication with terrestrial transmission and reception stations, the upper band monopole height 8 at the upper frequency limit of the upper band should not be larger than approximately ⅓ of the free wavelength at this frequency. Values between 30 and 90 degrees have proven favorable as the triangular opening angle 12. The triangular structure of broadband effect thereby arising makes it possible, for example, to satisfy the frequently made demand on the impedance matching at the nadir at a value of VSWR <3-3.5 in the frequency range of the upper band O.

Provision is made in an advantageous embodiment of the invention for the fine tuning of the cooperation between the lower band monopole 2 and the upper band monopole 1 to introduce a circuit element having the mode of operation of a parallel resonant circuit 28 into the first conductor strips 15. This parallel resonant circuit serves for supporting the frequency-selective separation of the lower band monopole 2 from signals in the upper band. In accordance with the invention, the parallel resonant circuit 28, as shown in FIG. 10 respectively comprises a parallel capacitor 27 designed as an interdigital structure 26 and a parallel inductance 28 designed as a strip conductor. This circuit element can also be included, stamped or cut by way of example from sheet metal, via the first conductor strips 15, 15*a* or via the further conductor strips 39, 39*a* in the configuration of the mechanically self-supporting multistructure broadband monopole antenna 0 or with an antenna in accordance with the invention attached to a circuit board (see FIG. 11).

On the presence of a ring-shaped satellite reception antenna 25 arranged concentrically to the antenna connection site 3, it is proposed in accordance with the invention, for the improvement of the electromagnetic decoupling, to configure the triangular structure 4 by strip-shaped lamellas 20 arranged in a fan-like manner in the triangular plane and running together in the apex and to configure both the first rectangular structure 16 and the further rectangular structure 42 substantially by strip-shaped roof lamellas 19, 19*a*, 19*b* extending vertically electrically conductively separately from one another, but contiguous at their upper end via a remaining strip 31, such as is shown in FIG. 13 for the antenna in accordance with the invention and in FIG. 12 for the exclusively first structure.

For the further improvement of the frequency bandwidth of the upper band monopole 1 a three-dimensional structure for it is provided in an advantageous embodiment of the invention, the three-dimensional structure being formed from the two-dimensional structure in a manner such that an approximately conical structure is aimed for instead of the areal triangular structure 4. The shape of such a monopole is indicated in FIG. 14 with reference to the conical monopole 18 having electrically conductive jacket surfaces. In this respect, the economically advantageous manufacturing capability from stamped or cut sheet metal is to be maintained. Provision is therefore made in accordance with the invention to design the areal triangular structure 4 by strip-shaped lamellas 20 running together in the manner of a fan in the lower triangle apex, as shown in FIGS. 9, 12, 13. By angling the lamellas 20 such that they lie on the jacket surface of a cone standing on its apex, they become conical lamellas 30 and the conical monopole 18 in FIG. 14 is emulated with respect to its effect as an upper band monopole 1. This is shown in detail in FIG. 15 and equally becomes visible as a plan view in accordance with the line indication A-A' in FIG. 16. In FIG. 16, the conical cross-section indicated in FIG. 15 is elliptical and thus the cone opening angle 17*a* (FIG. 15) is selected smaller in the x direction due to the demands with respect to the aerodynamic properties of the antenna than the cone opening angle 17 in the direction of travel of the vehicle (y direction).

Due to the tight construction spaces, the main demand exists with vehicle antennas for small size and in particular also to minimize the basic outline of the antenna. In this respect, the deformation of the radiation diagram of the satellite antenna is in particular problematic for satellite radio surfaces and antennas for other radio services in tight space due to the radiation coupling between the antennas. This problem is also present when—as in FIGS. 9, 12, 13, 15—at least one ring-shaped satellite reception antenna 25 is present that is arranged concentrically to the antenna connection site 3 of a multistructure broadband monopole antenna 0. There is the strict demand for this, e.g. in accordance with the standard for satellite broadcasting SDARS, in the zenith angular range (angle with respect to the z axis) e.g. between 0 and 60 degrees for an antenna gain which amounts in dependence on the operator for circular polarization of a constant e.g. 2 dBi or e.g. 3 dBi respectively with an azimuthal fluctuation of less than 0.5 dB. In this connection, the configuration of the triangle structure 4 from lamellas 20 running together in the manner of a fan at the apex, as in FIG. 9, is more favorable than a closed areal triangular structure 4 in accordance with FIG. 3, for example. This advantage of the small influencing of the radiation properties of the satellite reception antenna 25 is particularly pronounced on the configuration of the upper band monopole 1 from conical lamellas 30. By avoiding ring currents which are caused by the currents on the satellite antenna 25 on a conductive cone envelope of the upper band monopole 1 by radiation coupling of the two antennas and on the configuration of the cone envelope from conical lamellas 30 of the upper band monopole 1, the latter is practically without any influence on the radiation properties of the satellite reception antenna 25.

In order also to complete the electromagnetic decoupling between the satellite reception antenna 25 and the areal first rectangular structure 16 of the lower band monopole 2 forming the first roof capacitor 10, said first rectangular structure can be configured in accordance with the invention substantially by strip-shaped roof lamellas 19 extending vertically electrically conductively separately from one another, but contiguous at their upper end via a remaining strip 31, as shown in FIGS. 13 and 14 for an antenna in accordance with the invention both for the first rectangular structure 16 and for the further rectangular structure 42. In this respect, their strip width 21 should in each case not be larger than ⅛ of the free wavelength of the highest frequency in the upper band.

FIG. 19 shows an advantageous example of a multistructure broadband monopole antenna 0 in accordance with the invention as in FIG. 13, wherein the strip-shaped lamellas 20 are angled out of the y-z plane of the areal triangular structure 4 split in the direction of the positive x axis (lamellas 20*a*) and of the negative x axis (lamellas 20*b*) respectively by the deflection angle 49 such that the upper band monopole 1 is formed by these lamellas substantially by two triangular structures 4*a* and 4*b* standing on their apices, and wherein all the lower ends of the lamellas 20*a*, 20*b* are combined in the triangular apices in the antenna connection point 5, together with the lower end of the first conductor strip 15 positioned at the center of the arrangement. The surface normals of these triangles thus lie substantially in the x-z plane, i.e. in the same plane as the surface normals of the first rectangular structure 16 and of the further rectangular structure 42. A spatial antenna structure having a larger frequency bandwidth is thereby formed in the upper band 0. Contiguously conductive triangular surfaces 4*a*, 4*b* can also be configured instead of the triangular structures formed from lamellas with respect to the impedance matching. The first conductor strip 15 and the further conductor strip 39 are shown in simplified form as straight conductor strips and can contain shapes meandering in their realization, as in FIGS. 13 and 18. The surface normals of the rectangular structures of the first roof capacitor 10 and those of the further roof capacitor 38 face in the x direction.

Provision is frequently made to accommodate a multistructure broadband monopole antenna 0 beneath a cover hood 32 made from plastic material, as is shown in FIG. 20 with a view transversely to the direction of travel (y direction) and in FIG. 21 with a view in the direction of travel (direction of travel=y direction). In this respect, the extent of the cover hood 32 transversely to the direction of travel visible in FIG. 21 makes possible the option of a further spatial configuration of the originally areally produced multistructure broadband monopole antenna 0 with the advantages of the increasing of the bandwidths of both monopoles 1 and 2. This is expressed by a better configurability of the antenna impedance with respect to the VSWR value at the antenna connection site 3. The possibility is thereby given of largely being able to dispense with a matching network.

FIG. 20 shows the installation situation of a multistructure broadband monopole antenna 0 in accordance with the invention in accordance with FIG. 19 on the outer skin of a vehicle under a cover hood 32 in a weakly perspective representation with a view of the antenna approximately from the x direction, that is transversely to the direction of travel (direction of travel=y direction). The conductor parts shaded in black and marked by a)—that is the lamellas 20*a*—are angled out of the y-z plane of the areal triangular structure 4 in the direction of the x axis and are angled out in the direction of the negative x axis in accordance with the lamellas 20*b*, whereby the spatial antenna structure for the upper band monopole 1 is formed;

Analogously to the configuration of a cone having an elliptical cross-section by a corresponding deflection of the lamellas 20, 20*a*, 20*b* of the upper band monopole 1 in FIG. 14 and FIG. 15, in a further advantageous embodiment of the invention, the lamellas 20, 20*a*, 20*b* can be angled approximately following the inner boundary of the cover hood 32. This means that the strip-shaped lamellas 20, 20*a*, 20*b* of the upper band monopole 1 running together in the bottom triangle apex are bent out of the plane of the areal triangular structure 4 following one another in a manner such that they are arranged approximately in V shape in the projection onto a plane disposed transversely to the direction of travel. In this respect, the lamellas 20 are angled out in a manner such that the lamellas 20*a* marked in solid black in FIG. 20 are deflected in the x direction and the lamellas 20*b* marked in solid white are deflected in the negative y direction, in opposite senses, so that the V-shaped structure visible in projection in FIG. 21 is present. This measure here also serves for increasing the frequency bandwidth of the upper band monopole 1 with the associated advantage in the realization of the impedance matching at the antenna nadir.

It must generally be observed that the spatial configuration in accordance with the invention starting from the described two-dimensional configuration of the monopole antenna 0 in accordance with the invention is additionally advantageous with respect to the problem of impedance matching over large frequency ranges. The special advantage is thus associated with the present invention that this spatially configured antenna can be stamped or cut from an areal, electrically conductive structure (sheet metal or foil) and can be configured, as described above, by a simple subsequent bending.

The installation situation of a multistructure broadband monopole antenna 0 in accordance with the invention—in a similar manner as in FIG. 20—but with a view of the arrangement in the direction of travel (direction of travel=y direction) in particular shows in FIG. 21 overall the advantageous configuration of the invention as a spatial antenna. The esthetic demand for a downwardly flaring cover hood 32 offers the possibility of using this space in the interest of achieving a larger bandwidth for the upper band monopole 1. The impedance curve in the upper band O can be configured in accordance with the demand of VSWR <3 by a suitable choice of the deflection angle 49 and by the length of the lamellas 20*a*, 20*b*.

An advantageous further development of the multistructure broadband monopole antenna 0 in FIG. 19 is shown in FIG. 22. In this respect, the upper band monopole 1 comprises two triangles 4*a* and 4*b* standing on their apices and angled out in each case in positive or negative x directions by the deflection angle 49 related to the direction of the z axis, as in FIG. 19, but with triangular apices offset symmetrically with respect to the first conductor strips 15 in the x direction by the offset length 50. The triangular apices are connected to one another and to the first conductor strip 15 at the branch point 47 via a short connection conductor 48 having a base surface spacing 51 guided via the conductive base surface 6 in parallel with the x axis. The antenna connection point 5 is formed starting from said branch point. By a suitable choice of the offset length 50 and of the deflection angle 49 and of the length of the lamellas 20*a* and

20*b* in conjunction with the capacitive effect of the connection conductor 48 guided at the base surface spacing 51 of some millimeters above the base surface 6, the required degrees of freedom for the setting of the impedance matching over the total frequency range of the upper band O are given.

In a further advantageous use of a multistructure broadband monopole antenna 0 in accordance with the invention, this is supplemented by a further multistructure broadband monopole antenna the same as it to form a dipole in a manner known per se. In this respect, the mirror image of the multistructure broadband monopole antenna 0 at the conductive base surface 6 is replaced, while being dispensed with, by this further multistructure broadband monopole antenna in a manner such that a dipole symmetrical to the plane of the conductive base surface 6 is given. In this respect, the symmetrical antenna connection site of this dipole is formed between the antenna connection point 5 of the multistructure broadband monopole antenna 0 and the antenna connection point 5—corresponding thereto—mirrored at the conductive base surface 6. The free end of a further conductor strip is connected in an analog manner to the free end of its mirror image.

In a further advantageous application of a multistructure broadband monopole antenna 0 in accordance with the invention, a coupling conductor 35 is present which is connected at its upper end to the first roof capacitor 10, which extends toward the conductive base surface 6, in order to assist the impedance matching at the lower frequency end of the lower band, and which is coupled at its lower end to the conductive base surface 6. This coupling conductor 35 is shown in FIG. 18 and complements the lower band monopole 2 in a manner such that it is possible to improve the impedance matching at the antenna connection site 3 to the lower frequency end of the lower band. By configuring the coupling conductor width 37 or by a partly meandering shape 24 of the coupling conductor 35, its inductive effect can be suitably set to the demands for the impedance matching (e.g. VSWR <3 or <3.5). With a sufficiently inductively high-impedance design of the coupling conductor 35, the latter is not effective in the frequency range of the upper band monopole 1 in a manner such that its radiation properties are not thereby impaired. It is in many cases advantageous in this respect to establish the coupling of the coupling conductor 35 to the conductive base surface 6 at its lower end galvanically or capacitively. In particular with a particularly small antenna height 9, the impedance matching can be improved in that this coupling of the coupling conductor 35 to the conductive base surface 6 takes place via a dipolar coupling network 36 comprising blind elements (not shown in any more detail in FIG. 18). It can also be advantageous in a special case to configure the coupling network 36 suffering slightly from loss in order to observe a specific VSWR value at the lower frequency band of the lower band while accepting radiation losses which are as small as possible.

To check the connection of an antenna via the antenna feed line, a predefined DC current resistance value, frequently approximately up to 1000 ohms, is demanded at the antenna connection site in automotive engineering. To satisfy this demand, provision can be made in accordance with the invention to connect a high-impedance test conductor having a DC current resistance demanded for this purpose between the first structure and the further structure, preferably between the conductive rectangular structure 16 and the further rectangular structure 42 for the purpose of the connection test of the antenna. In order not to impair the function of the antenna in accordance with the invention by this measure, this test conductor is to be configured with sufficiently high impedance both in the lower band U and in the upper band O. Plastic materials to be introduced between the two roof capacitors and of limited electrical conductivity are preferably provided for this purpose.

REFERENCE NUMERAL LIST

Multistructure broadband monopole antenna 0
Upper band monopole 1
Lower band monopole 2
Antenna connection site 3
Triangular structure 4, 4*a*, 4*b*
Antenna connection point 5
Conductive base surface 6
Ground connection point 7
Upper band monopole height 8
Antenna height 9
First roof capacitor 10
Frame structure 11
Triangular opening angle 12
Spacing 13
Strip conductor width 14
First conductor strips 15, 15*a*, 15*b*
First triangular structure 16
Conical opening angle in they direction 17
Conical opening angle in the x direction 17*a*
Conical monopole 18
Roof lamella 19
Strip-shaped lamellas 20, 20*a*, 20*b*
Strip width 21
Vertical extent 22
Horizontal extent 23
Meandering shape 24
Ring-shaped satellite reception antenna 25
Interdigital structure 26
Parallel capacitance 27
Parallel inductance 28
Parallel resonant circuit 29
Conical lamella 30, 30*a*, 30*b*
Remaining strip 31
Cover hood 32
Electrically conductive foil 33
Coupling conductor 35
Coupling network 36
Coupling conductor width 37
Further roof capacitor 38
Further conductor strip 39, 39*a*
Roof capacitor coupling spacing 40
Conductor strip coupling spacing 41
Further rectangular structure 42
Base surface connection point 43
Coaxial plug-in connection 44
Coaxial plug outer conductor 45
Additional ground connector 46
Branch point 47
Connection conductor 48
Deflection angle 49
Offset length 50
Base surface spacing 51
Center axis Z

The invention claimed is:

1. A vertical broadband monopole antenna for vehicles for two frequency bands, namely a lower band for lower frequencies and an upper band for higher frequencies, separated by a frequency gap and both disposed in the decimeter wave spectrum, for transmitting and/or receiving using terrestrially broadcast, vertically polarized radio signals over a substantially horizontal conductive base surface as a vehicle ground having an antenna connection site located in the monopole nadir comprising the following features:

the broadband monopole antenna is configured from a first and a further electrically conductive structure which are oriented above and substantially perpendicular to the base surface;

the first electrically conductive structure comprises at the lower end of the broadband monopole antenna at least one triangular structure standing on its apex and having a substantially horizontal baseline, the apex forming an antenna connection point of the antenna connection site;

the first electrically conductive structure comprises, adjacent to and beneath the upper end of the broadband monopole antenna, a first roof capacitor substantially designed as a first rectangular structure;

the triangular structure and the first rectangular structure are inductively connected with high impedance by at least one first conductor strip for separating radio signals in the upper band;

the further electrically conductive structure comprises a further roof capacitor that is guided substantially in parallel with the first rectangular structure and that is configured as a further areal structure, that is capacitively coupled to the first roof capacitor, and that is in particular substantially formed as a rectangular structure;

the further electrically conductive structure comprises at least one further inductively high-impedance conductor strip for the separation of radio signals in the upper band that, connected to the further areal structure, is conductively connected at its lower end, extending toward the conductive base surface, to the latter, wherein the triangular structure is configured by strip-shaped lamellas arranged in the manner of a fan and running together at the apex in the triangle plane.

2. The broadband monopole antenna in accordance with claim 1, wherein the first electrically conductive structure has at least two spaced apart first conductor strips, whereby a frame structure is formed comprising the triangular structure or the conical structure, the first rectangular structure and the first conductor strip.

3. The broadband monopole antenna in accordance with claim 1, wherein the internal angle at the apex of the triangular structure amounts approximately to between 30 and 90 degrees.

4. The broadband monopole antenna in accordance with claim 1, wherein the further electrically conductive structure is configured in a manner such that the further conductor strip is connected to the further roof capacitor in the region of one of the side ends and is guided at a conductor strip coupling spacing from the side margin of the triangular structure to the conductive base surface and is conductively connected thereto at its lower end.

5. The broadband monopole antenna in accordance with claim 1, wherein the at least one first conductor strip and the at least one further conductor strip contain meandering shapes for the frequency-selective separation.

6. The broadband monopole antenna in accordance with claim 1, wherein the further electrically conductive structure is configured in a manner such that two further conductor strips are present of which each is connected—disposed opposite one another—to the further roof capacitor in the region of a respective one of the side ends and is guided at a spacing from the side margin of the triangular structure or of the conical structure to the conductive base surface and is conductively connected thereto at its lower end.

7. The broadband monopole antenna in accordance with claim 1, wherein at least one of the further conductor strips is guided at a conductor strip coupling spacing substantially in parallel with a respective first conductor strip and can be conductively connected at its lower end to the conductive base surface.

8. The broadband monopole antenna in accordance with claim 1, wherein the first electrically conductive structure and the further electrically conductive structure are applied together to a circuit board by a metallic coating and the antenna connection site of the broadband monopole antenna is designed at the lower end of the circuit board as either having a ground connection point and a base surface connection point at the conductive base surface or a plug-in connection having a ground connection point and a base surface connection point at the conductive base surface.

9. The broadband monopole antenna in accordance with claim 1, wherein at least one of the first rectangular structure and the further areal structure is substantially formed by strip-shaped lamellas extending electrically conductively separately from one another, but contiguous at their end.

10. The broadband monopole antenna in accordance with claim 1, wherein a coupling conductor is present that is inductively connected with high impedance to the first roof capacitor at least in the frequency range of the upper band and that is electrically conductively connected at its lower end to the conductive base surface.

11. The broadband monopole antenna in accordance with claim 1, wherein the first electrically conductive structure comprises two areal triangular structures that are substantially formed by two triangles standing on their apices whose surface normals lie in the same plane as the surface normals of the first rectangular structure, with the triangular structures being formed by strip-shaped lamellas starting from the antenna connection site and the triangular structures each being angled out by a deflection angle with respect to a center axis.

12. The broadband monopole antenna in accordance with claim 11, wherein the triangle apices of the triangles angled out by the deflection angle are offset with respect to one another approximately symmetrically to the antenna connection point by an offset length and are connected to one another via a connection conductor guided in parallel with the base surface at a base surface spacing in a branch point and the antenna connection point is formed starting from the latter.

13. The broadband monopole antenna in accordance with claim 1, wherein a test conductor having a high-impedance DC current resistor is connected either between the first conductive structure and the further conductive structure or between the conductive rectangular structure and the further rectangular structure, for the purpose of a connection test of the antenna.

14. A vertical broadband monopole antenna for vehicles for two frequency bands, namely a lower band for lower frequencies and an upper band for higher frequencies, separated by a frequency gap and both disposed in the decimeter wave spectrum, for transmitting and/or receiving using terrestrially broadcast, vertically polarized radio signals over a substantially horizontal conductive base surface as a vehicle ground having an antenna connection site located in the monopole nadir, comprising the following features:

the broadband monopole antenna is configured from a first and a further electrically conductive structure which are oriented above and substantially perpendicular to the base surface;

the first electrically conductive structure comprises at the lower end of the broadband monopole antenna a conical structure standing on its apex and having a substantially horizontal baseline, the apex forming an antenna connection point of the antenna connection site;

the first electrically conductive structure comprises, adjacent to and beneath the upper end of the broadband monopole antenna, a first roof capacitor substantially designed as a first rectangular structure;

the conical structure and the first rectangular structure are inductively connected with high impedance by at least one first conductor strip for separating radio signals in the upper band;

the further electrically conductive structure comprises a further roof capacitor that is guided substantially in parallel with the first rectangular structure and that is configured as a further areal structure to which the first roof capacitor is capacitively coupled, and is in particular substantially formed as a rectangular structure;

the further electrically conductive structure comprises at least one further inductively high-impedance conductor strip for the separation of radio signals in the upper band that, connected to the further areal structure, is conductively connected at its lower end, extending toward the conductive base surface, to the latter, wherein the conical structure is configured by strip-shaped lamellas arranged in the manner of a fan and running together at the apex that are angled out of the triangular plane such that they extend substantially on the jacket surface of a cone standing on its apex and having a circular or elliptical cross-section.

15. The broadband monopole antenna in accordance with claim 14, wherein the first electrically conductive structure has at least two spaced apart first conductor strips, whereby a frame structure is formed comprising the triangular structure or the conical structure, the first rectangular structure and the first conductor strip.

16. The broadband monopole antenna in accordance with claim 15, wherein the internal angle at the apex of the triangular structure amounts approximately to between 30 and 90 degrees.

17. The broadband monopole antenna in accordance with claim 15, wherein the first electrically conductive structure and the further electrically conductive structure are applied together to a circuit board by a metallic coating and the antenna connection site of the broadband monopole antenna is designed at the lower end of the circuit board as either having a ground connection point and a base surface connection point at the conductive base surface or a plug-in connection having a ground connection point and a base surface connection point at the conductive base surface.

18. The broadband monopole antenna in accordance with claim 15, wherein the first electrically conductive structure comprises two areal triangular structures that are substantially formed by two triangles standing on their apices whose surface normals lie in the same plane as the surface normals of the first rectangular structure, with the triangular structures being formed by strip-shaped lamellas starting from the antenna connection site and the triangular structures each being angled out by a deflection angle with respect to a center axis.

19. The broadband monopole antenna in accordance with claim 18, wherein the triangle apices of the triangles angled out by the deflection angle are offset with respect to one another approximately symmetrically to the antenna connection point by an offset length and are connected to one another via a connection conductor guided in parallel with the base surface at a base surface spacing in a branch point and the antenna connection point is formed starting from the latter.

20. The broadband monopole antenna in accordance with claim 14, wherein the further electrically conductive structure is configured in a manner such that the further conductor strip is connected to the further roof capacitor in the region of one of the side ends and is guided at a conductor strip coupling spacing from the side margin of the triangular structure to the conductive base surface and is conductively connected thereto at its lower end.

21. The broadband monopole antenna in accordance with claim 14, wherein the at least one first conductor strip and the at least one further conductor strip contain meandering shapes for the frequency-selective separation.

22. The broadband monopole antenna in accordance with claim 14, wherein the further electrically conductive structure is configured in a manner such that two further conductor strips are present of which each is connected—disposed opposite one another—to the further roof capacitor in the region of a respective one of the side ends and is guided at a spacing from the side margin of the triangular structure or of the conical structure to the conductive base surface and is conductively connected thereto at its lower end.

23. The broadband monopole antenna in accordance with claim 14, wherein at least one of the further conductor strips is guided at a conductor strip coupling spacing substantially in parallel with a respective first conductor strip and can be conductively connected at its lower end to the conductive base surface.

24. The broadband monopole antenna in accordance with claim 14, wherein at least one of the first rectangular structure and the further areal structure is substantially formed by strip-shaped lamellas extending electrically conductively separately from one another, but contiguous at their end.

25. The broadband monopole antenna in accordance with claim 14, wherein a coupling conductor is present that is inductively connected with high impedance to the first roof capacitor at least in the frequency range of the upper band and that is electrically conductively connected at its lower end to the conductive base surface.

26. The broadband monopole antenna in accordance with claim 14, wherein a test conductor having a high-impedance DC current resistor is connected either between the first conductive structure and the further conductive structure or between the conductive rectangular structure and the further rectangular structure, for the purpose of a connection test of the antenna.

* * * * *